US011476065B2

(12) United States Patent
Kamei et al.

(10) Patent No.: US 11,476,065 B2
(45) Date of Patent: Oct. 18, 2022

(54) CONNECTOR DEVICE

(71) Applicant: Japan Aviation Electronics Industry, Limited, Tokyo (JP)

(72) Inventors: Yuji Kamei, Tokyo (JP); Yuichiro Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/509,193

(22) Filed: Oct. 25, 2021

(65) Prior Publication Data

US 2022/0208486 A1 Jun. 30, 2022

(30) Foreign Application Priority Data

Dec. 25, 2020 (JP) ..... JP2020-216465

(51) Int. Cl.
*H01H 21/30* (2006.01)
*H01H 21/54* (2006.01)
*H01H 21/04* (2006.01)

(52) U.S. Cl.
CPC ..... *H01H 21/30* (2013.01); *H01H 21/54* (2013.01); *H01H 21/04* (2013.01); *H01H 2225/01* (2013.01); *H01H 2231/026* (2013.01)

(58) Field of Classification Search
CPC ..... H01H 21/30; H01H 21/54; H01H 21/04; H01H 1/58; H01R 13/62; H01R 13/64; H01R 13/62977; H01R 13/62933
USPC ..... 200/5 R, 51 R
See application file for complete search history.

(56) References Cited

U.S. PATENT DOCUMENTS 9,325,112 B2 4/2016 Tabata et al.
9,966,701 B2 5/2018 Tabata et al.
10,008,805 B2 * 6/2018 Tabata ..... H01R 13/7036
(Continued)

FOREIGN PATENT DOCUMENTS

EP 3 444 906 A1 2/2019
JP 2015-050116 A 3/2015
(Continued)

OTHER PUBLICATIONS

Extended European Search Report in EP 21205144.5-1201, dated Apr. 12, 2022.

*Primary Examiner* — Edwin A. Leon
*Assistant Examiner* — Iman Malakooti
(74) *Attorney, Agent, or Firm* — Collard & Roe, P.C.

(57) ABSTRACT

A connector device comprises a connector and a mating connector. The connector comprises a housing and a slider having a second regulated portion. The mating connector comprises a mating housing having a second regulation portion. The connector is movable between an open position and a closed position. The slider is held by the housing to be movable between a first position and a second position. When the connector is moved to a predetermined position together with the slider which is located at the second position upon a movement of the connector from the closed position toward the open position, the second regulated portion is brought into abutment with the second regulation portion, and a movement of the connector toward the open position beyond the predetermined position is regulated. When the slider is moved to the first position, the connector is movable to the open position.

7 Claims, 24 Drawing Sheets

(56) References Cited

U.S. PATENT DOCUMENTS

| | | | | |
|---|---|---|---|---|
| 10,651,595 | B2 * | 5/2020 | Yamane ..... | H01R 13/62933 |
| 2018/0054025 | A1 | 2/2018 | Tabata et al. | |

FOREIGN PATENT DOCUMENTS

| | | | |
|---|---|---|---|
| JP | 2018-028990 | A | 2/2018 |
| JP | 2018-081894 | A | 5/2018 |

* cited by examiner

CONNECTOR DEVICE

CROSS REFERENCE TO RELATED APPLICATIONS

This application is based on and claims priority under 35 U.S.C. § 119 to Japanese Patent Application No. JP 2020-216465 filed Dec. 25, 2020, the content of which is incorporated herein in its entirety by reference.

BACKGROUND OF THE INVENTION

This invention relates to a connector device which is configured to be incorporated in an electric vehicle such as an electric car or a hybrid car to transmit electric power supplied from a power system.

For example, this type of connector device is disclosed in JPA 2018-028990 (Patent Document 1), the content of which is incorporated herein by reference.

As shown in FIG. 44, Patent Document 1 discloses a connector device 90 comprising a connector 92 and a mating connector 96. The connector 92 is provided with an axis portion (not shown). The mating connector 96 is provided with a mating axis portion (not shown). The axis portion and the mating axis portion are combined to each other to form a pivot axis 91. The connector 92 is turnable about the pivot axis 91. In detail, the connector 92 is movable between an open position (not shown) and a closed position (not shown) via an intermediate position (see FIG. 44). The connector 92 stands up from the mating connector 96 at the open position and lies on the mating connector 96 at the closed position.

The connector 92 comprises a power terminal 93 and a detection terminal 94. The mating connector 96 comprises a mating power terminal 97 and a mating detection terminal (not shown). When the connector 92 is located at the open position (not shown), the power terminal 93 is not connected to the mating power terminal 97, and the detection terminal 94 is not connected to the mating detection terminal. The connector device 90 does not transmit electric power under this state. When the connector 92 is clockwise turned to be located at the predetermined position (see FIG. 4), the power terminal 93 is connected to the mating power terminal 97, but the detection terminal 94 is not connected to the mating detection terminal. The connector device 90 does not transmit electric power even under this state. When the connector 92 is further clockwise turned to be located at the closed position (not shown), the detection terminal 94 is connected to the mating detection terminal. As a result, the connector device 90 transmits electric power, and thereby a large current about 100 A flows between the power terminal 93 and the mating power terminal 97.

The aforementioned operation is performed in reversed order when the transmission of electric power is stopped. More specifically, the connector is counterclockwise turned from the closed position (not shown) to the open position (not shown) via the predetermined position (see FIG. 44). When the connector 92 is located at the predetermined position in accordance with this operation, a regulated portion 95, which is a part of the connector 92, is brought into abutment with a regulation portion 99, which is a part of the mating connector 96. As a result, the movement of the connector 92 is temporarily regulated. However, the connector 92 is provided with an operation portion 922. An operator can easily operate the operation portion 922 by using a finger, for example. When the aforementioned temporary regulation is released by operating the operation portion 922, the connector can be moved to the open position.

As can be seen from the explanation described above, the connector device 90 of Patent Document 1 has a mechanism which is configured to provide a predetermined period between the disconnection of the detection terminal and the disconnection of the power terminal. According to this mechanism, when electric current is completely stopped, a sufficient period has passed after the disconnection of the detection terminal from the mating detection terminal. Therefore, an electric shock of the operator can be prevented.

In general, a large part including an operation portion is necessary in order to operate the operation portion by using a finger, for example. According to the connector device 90 of Patent Document 1, this large part needs to be provided on an outer end of the connector 92 in a radial direction about the pivot axis 91 of the connector 92. The connector 92, which is provided with this large part, will be made large.

SUMMARY OF THE INVENTION

It is therefore an object of the present invention to provide a connector device which is configured to provide a sufficiently long period between disconnection of a detection terminal and disconnection of a power terminal and which enables a connector to be reduced in size.

An aspect of the present invention provides a connector device comprising a connector and a mating connector. The connector and the mating connector are mateable with each other. The connector comprises a housing, a power terminal and a detection terminal. The power terminal and the detection terminal are held by the housing. The mating connector comprises a mating housing, a mating power terminal and a mating detection terminal. The mating power terminal and the mating detection terminal are held by the mating housing. The housing is provided with an axis portion. The mating housing is provided with a mating axis portion. One of the axis portion and the mating axis portion is a pivot shaft, and a remaining one of the axis portion and the mating axis portion is a bearing. When the axis portion is combined to the mating axis portion, the connector is turnable about the pivot shaft between an open position and a closed position via a predetermined position. When the connector is located between the open position and the closed position, the connector is located is located at an upper side of the mating connector in an upper-lower direction perpendicular to an axis direction of the pivot shaft. When the connector is located at the open position, the power terminal is not connected to the mating power terminal, and the detection terminal is not connected to the mating detection terminal. When the connector is located at the predetermined position, the power terminal is connected to the mating power terminal, but the detection terminal is not connected to the mating detection terminal. When the connector is located at the closed position, the power terminal is connected to the mating power terminal, and the detection terminal is connected to the mating detection terminal. The connector further comprises a slider. The slider is held by the housing to be movable between a first position and a second position in a slide direction in parallel to a radial direction about the pivot shaft. The slider is provided with a first regulated portion and a second regulated portion. The mating housing is provided with a first regulation portion and a second regulating portion. When the connector is moved to the predetermined position together with the slider which is located at the first position in accordance with a movement of the connector from the open position toward the closed position, the first regulated portion is brought into abutment with the first regulation portion, and the connector takes a first regulated state where a movement of the connector toward the closed position beyond the predetermined position is regulated. When the slider of the connector which is under the first regulated state is moved to the second position, the first regulated state is released, and the connector is movable to the closed position. When the connector is moved to the predetermined position together with the slider which is located at the second position in accordance with a movement of the connector from the closed position toward the open position, the second regulated portion is brought into abutment with the second regulation portion, and the connector takes a second regulated state where a movement of the connector toward the open position beyond the predetermined position is regulated. When the slider of the connector which is under the second regulated state is moved to the first position, the second regulated state is released, and the connector is movable to the open position.

According to an aspect of the present invention, when the connector is located at the closed position, electric power is transmitted so that electric current flows between the power terminal and the mating power terminal. When the connector is located at the closed position, the slider is located at the second position. When the connector is moved to the predetermined position in accordance with a movement of the connector from the closed position toward the open position, the detection terminal is disconnected from the mating detection terminal so that the current is stopped. At that time, the second regulated portion of the slider is brought into abutment with the second regulation portion of the mating housing, and a movement of the connector toward the open position beyond the predetermined position is regulated. This movement regulation is released by moving the slider to the first position. The power terminal can be disconnected from the mating power terminal by moving the connector to the open position after the release of the movement regulation.

As can be seen from the explanation described above, an aspect of the present invention provides a sufficiently long period between the disconnection of the detection terminal and the disconnection of the power terminal. Thus, according to an aspect of the present invention, an operator can touch the power terminal and the mating power terminal only when the sufficiently long period has passed after the stop of electric current. Therefore, electric shock of the operator can be prevented.

According to an aspect of the present invention, the slider which is used to release the movement regulation can be arranged above the housing, for example. Thus, the slider does not need to be provided on an outer end of the housing in the radial direction. Therefore, the connector can be reduced in size. An aspect of the present invention provides a connector device which is configured to provide the sufficiently long period between disconnection of the detection terminal and disconnection of the power terminal and which enables the connector to be reduced in size.

An appreciation of the objectives of the present invention and a more complete understanding of its structure may be had by studying the following description of the preferred embodiment and by referring to the accompanying drawings.

Figure 1:
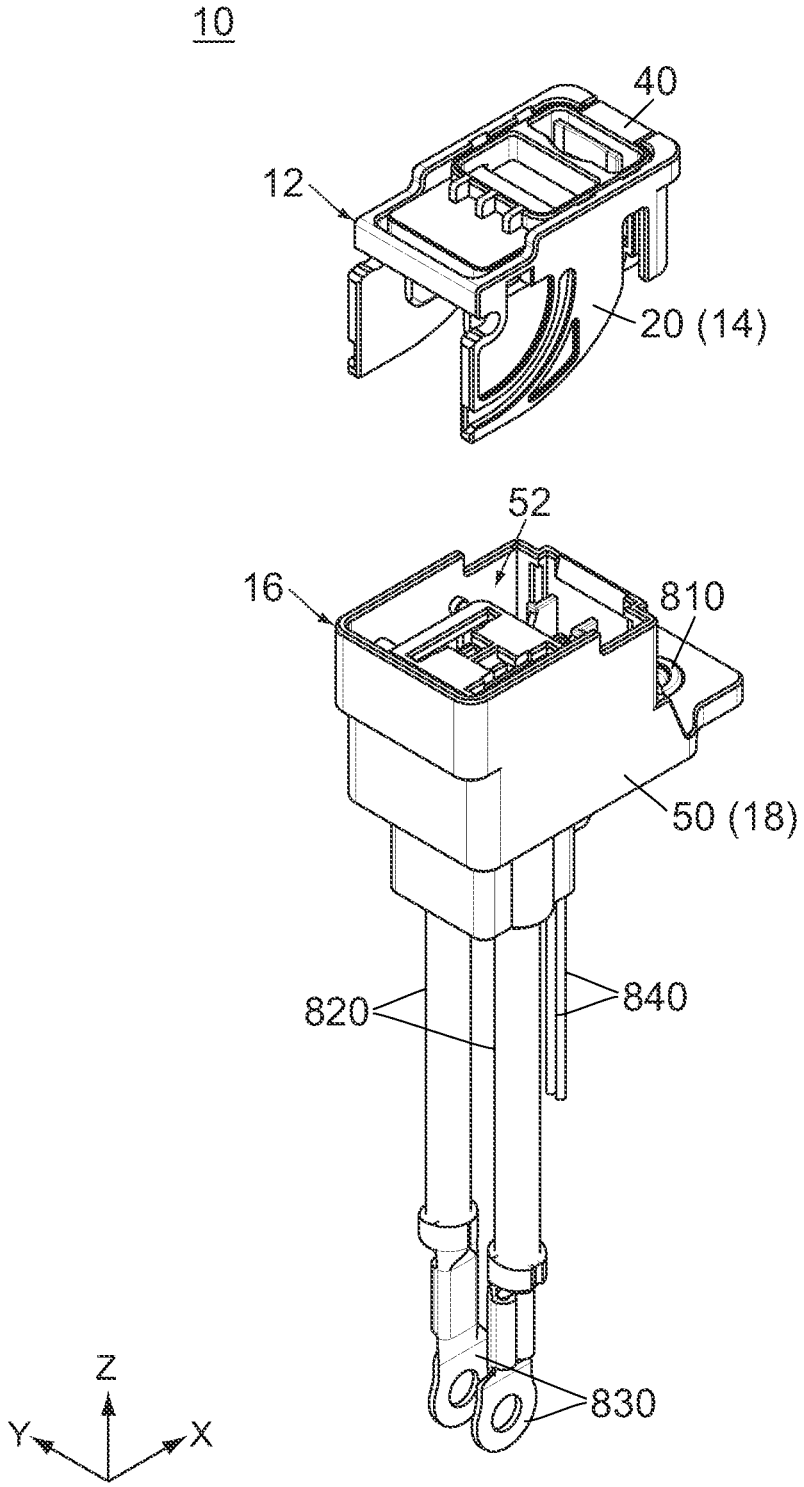
FIG. 1 is a perspective view showing a connector device according to an embodiment of the present invention, wherein a connector and a mating connector of the connector device are under a separated state where they are separated from each other, and the mating connector is connected to power cables and signal cables.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
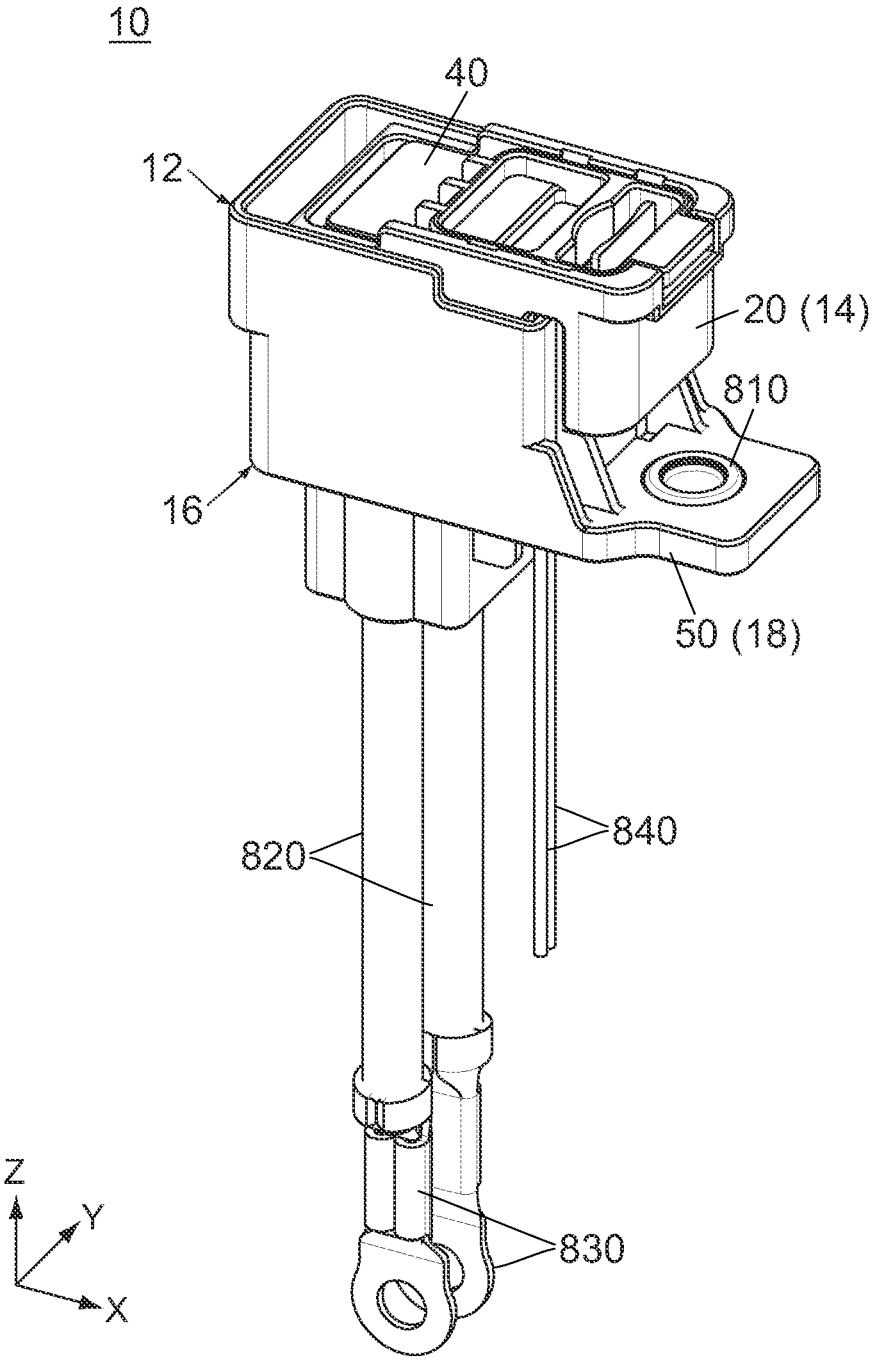
FIG. 2 is another perspective view showing the connector device of FIG. 1, wherein the connector and the mating connector are under a mated state where they are mated with each other.

As shown in FIGS. 1 and 2, a connector device 10 according to an embodiment of the present invention comprises a connector 12 and a mating connector 16. The connector 12 and the mating connector 16 are mateable with each other. The connector device 10 changes its state from a separated state (see FIG. 1) to a mated state (see FIG. 2) in accordance with a mating operation. The connector 12 and the mating connector 16 are separated from each other under the separated state. The connector 12 and the mating connector 16 are mated with each other under the mated state. The connector device 10 changes its state from the mated state to the separated state in accordance with a removing operation.

Referring to FIGS. 1 and 2, the mating connector 16 of the present embodiment is attached to an object (not shown) such as an electric car and is connected to a power system (not shown) and a motor (not shown). The connector device 10 electrically connects the power system and the motor with each other under the mated state (see FIG. 2). Under the mated state, a large current about 100 A supplied from the power system is transmitted to a motor via the connector device 10. However, the present invention is not limited thereto but is applicable to various connector devices 10.

Hereafter, explanation will be made about the mating connector 16 of the present embodiment.

Figure 3:
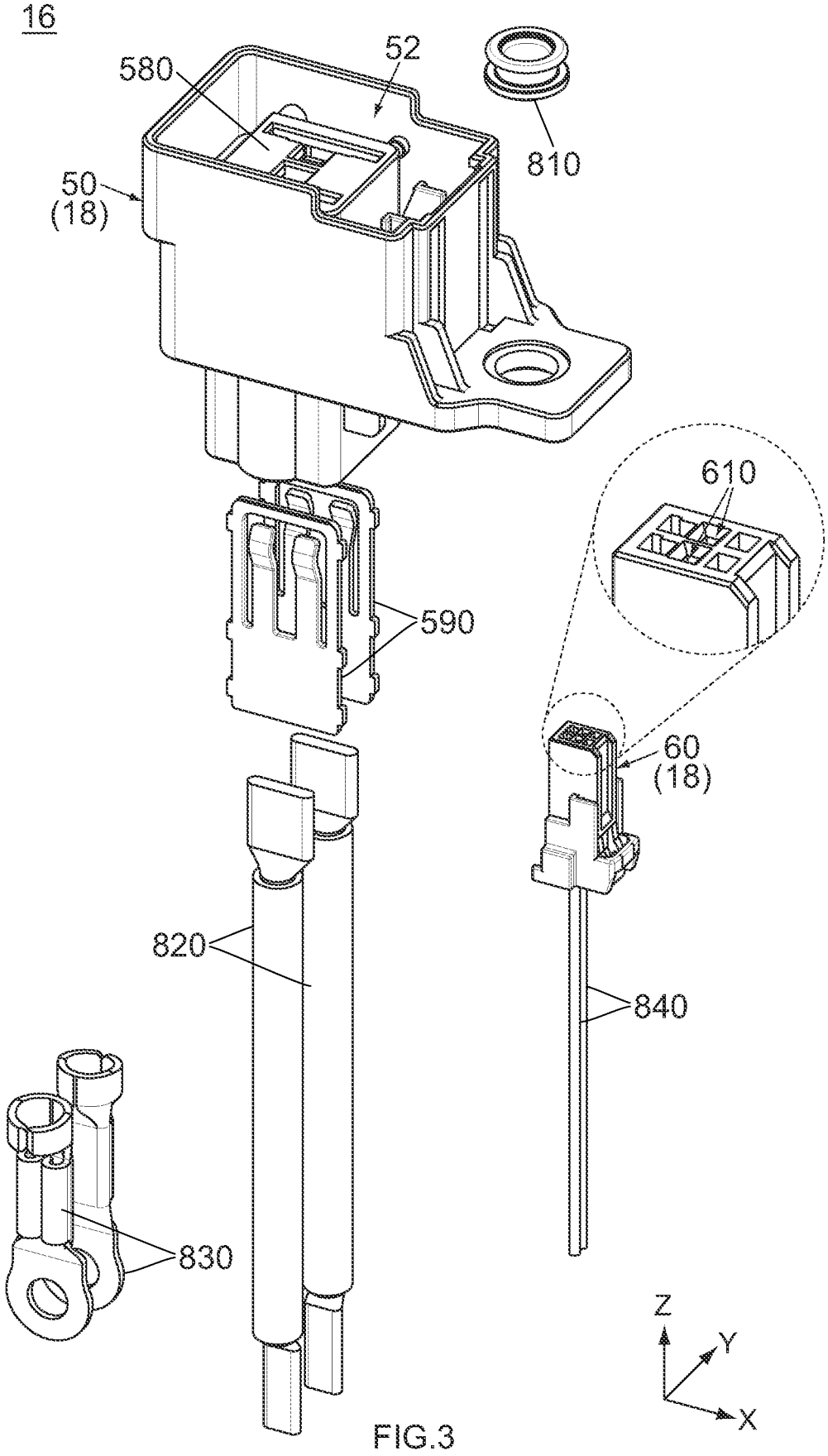
FIG. 3 is an exploded, perspective view showing the mating connector of FIG. 1 together with the power cables and the signal cables, wherein a part of a mating sub-housing of the mating connector enclosed by dashed line is enlarged and illustrated.
Figure 4:
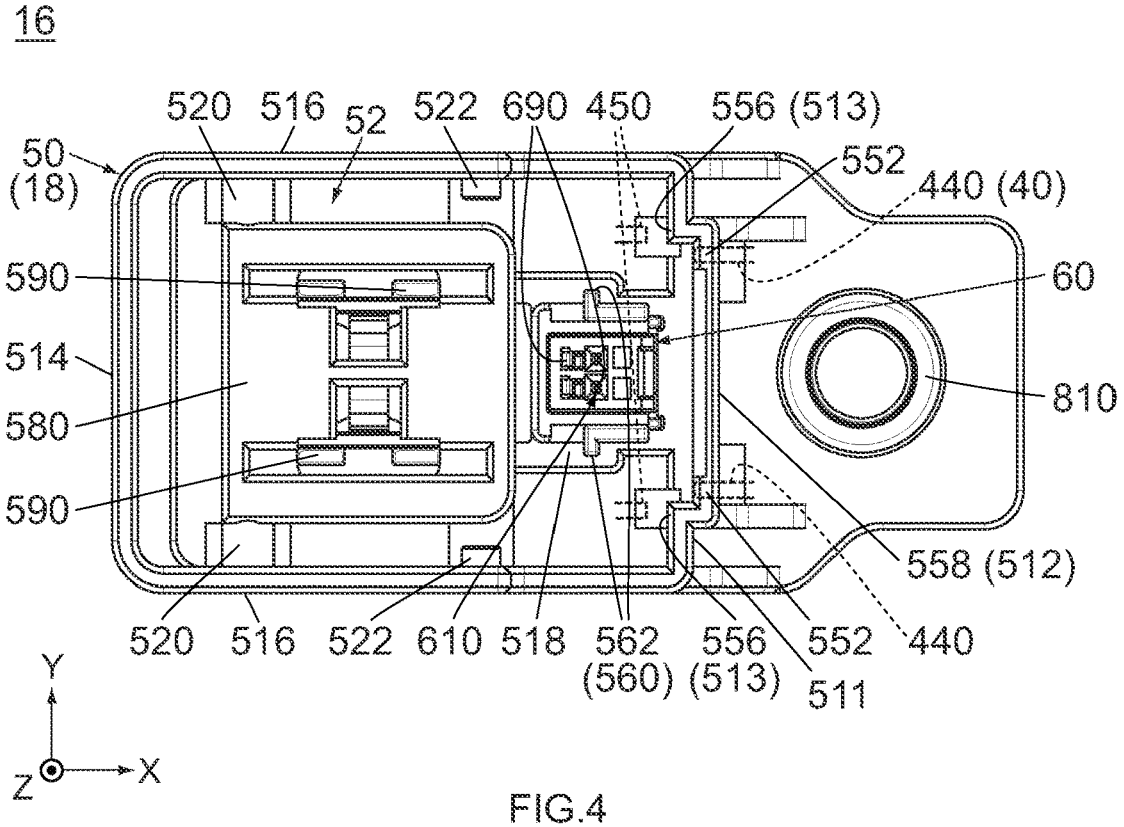
FIG. 4 is a top view showing the mating connector of FIG. 1, wherein a position of a slider of the connector which is located at a predetermined position is partially illustrated with dashed line.

Referring to FIGS. 3 and 4, the mating connector 16 of the present embodiment comprises a mating housing 18, two mating power terminals 590 each made of metal, two mating detection terminals 690 (see FIG. 4) each made of metal and an eyelet 810 made of elastomer. The mating housing 18 comprises a mating main housing 50 made of insulator and a mating sub-housing 60 made of insulator. The eyelet 810 is attached to the mating main housing 50.

The mating connector 16 of the present embodiment comprises the aforementioned members. However, the present invention is not limited thereto. For example, the mating main housing 50 and the mating sub-housing 60 may be integral to each other. In other words, each of the mating main housing 50 and the mating sub-housing 60 may be a part of the unitary mating housing 18. Moreover, the eyelet 810 may be provided as necessary. Instead, the mating connector 16 may comprise another member in addition to the aforementioned members.

Figure 5:
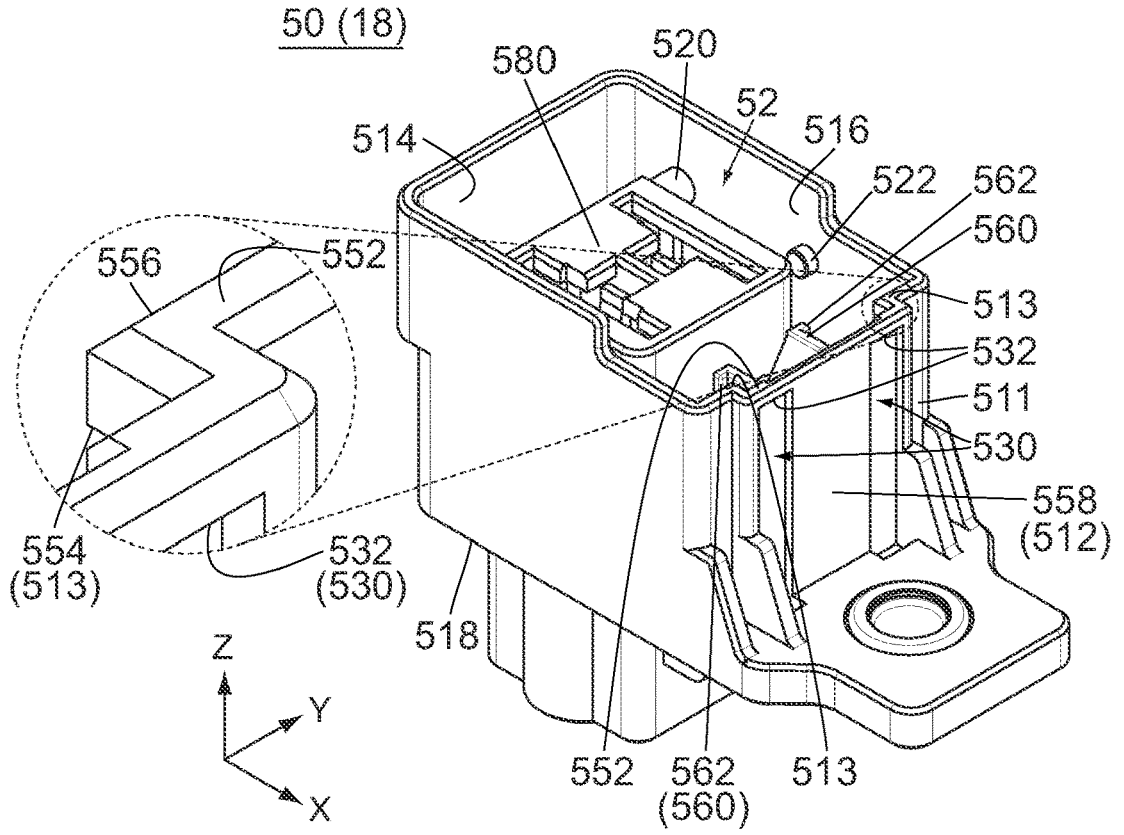
FIG. 5 is a perspective view showing a mating main housing of the mating connector of FIG. 3, wherein a part of the mating main housing enclosed by dashed line is enlarged and illustrated.
Figure 6:
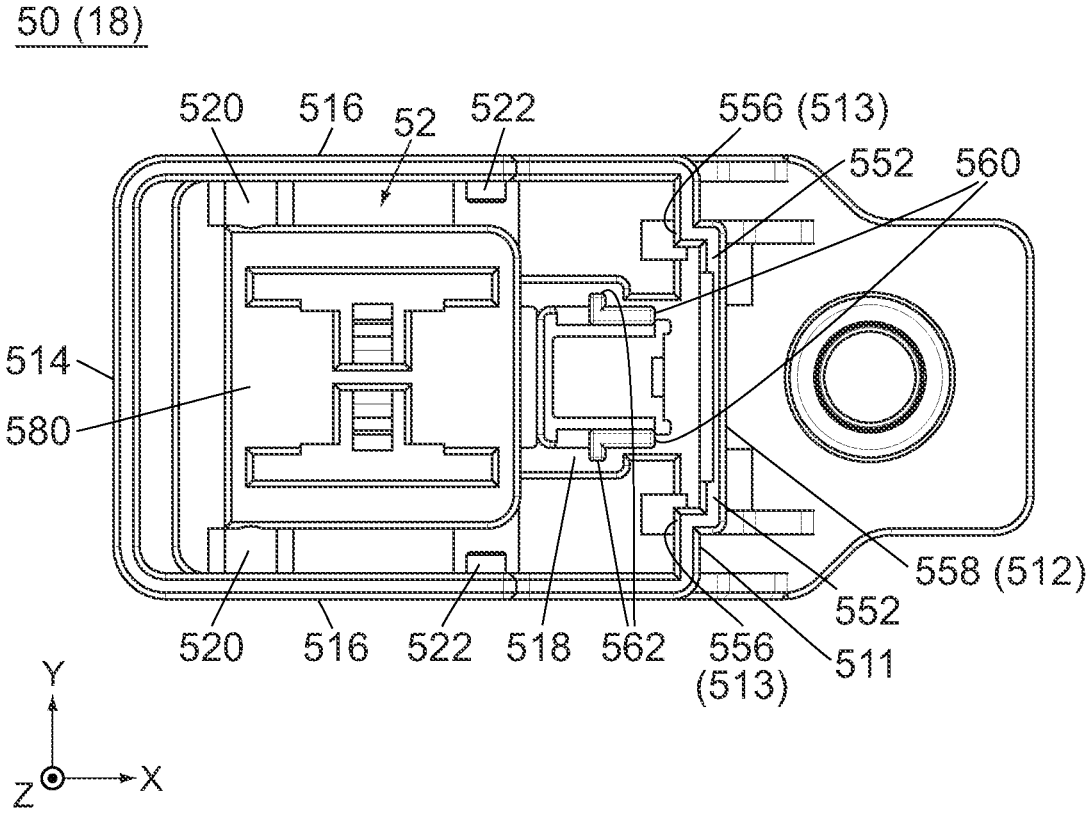
FIG. 6 is a top view showing the mating main housing of FIG. 5.

As shown in FIGS. 4 to 6, the mating main housing 50 has a front wall 511, a rear wall 514, two side walls 516 and a bottom portion 518. The front wall 511 is located at a front side (positive X-side) of the mating main housing 50 in a front-rear direction (X-direction). The rear wall 514 is located at a rear end (negative X-side end) of the mating main housing 50. The side walls 516 are located at opposite sides of the mating main housing 50, respectively, in a lateral direction (Y-direction) perpendicular to the X-direction. The bottom portion 518 is located at a lower side (negative Z-side) of the mating main housing 50 in an upper-lower direction (Z-direction) perpendicular to both the X-direction and the Y-direction.

Referring to FIGS. 4 to 6, the mating main housing 50 is formed with a receiving portion 52. The receiving portion 52 is a space enclosed by the front wall 511, the rear wall 514, the side walls 516 and the bottom portion 518. The receiving portion 52 opens upward, or in the positive Z-direction. The mating main housing 50 has a mating main holding portion 580. The mating main holding portion 580 is located in the receiving portion 52.

The mating main housing 50 of the present embodiment has the aforementioned basic structure. However, the present invention is not limited thereto, but the basic structure of the mating main housing 50 can be modified as necessary.

Referring to FIG. 4, the mating main holding portion 580 holds the mating power terminals 590. The mating sub-housing 60 is attached to the mating main housing 50 and is fixed to the mating main housing 50 so as to be unmovable relative to the mating main housing 50. The thus-attached mating sub-housing 60 is located in the receiving portion 52. The mating sub-housing 60 is located forward of the mating main holding portion 580 and faces the positive X-side of the mating main holding portion 580. The mating sub-housing 60 holds the mating detection terminals 690. Thus, the mating power terminals 590 and the mating detection terminals 690 are held by the mating housing 18.

The two mating power terminals 590 are arranged and are apart from each other in the Y-direction. The mating power terminals 590 are fixed to the mating main housing 50. The two mating detection terminals 690 are arranged and are apart from each other in the Y-direction. The mating detection terminals 690 are fixed to the mating sub-housing 60. Thus, each of the mating power terminals 590 and the mating detection terminals 690 is fixed to the mating housing 18 so as to be unmovable relative to the mating housing 18. Referring to FIGS. 3 and 4, the mating sub-housing 60 is formed with two connection holes 610. Referring to FIG. 4, when the mating sub-housing 60 is seen from above, the mating detection terminals 690 are partially visible through the connection holes 610, respectively.

Each of the mating main holding portion 580, the mating power terminals 590, the mating sub-housing 60 and the mating detection terminals 690 of the present embodiment has the aforementioned structure. However, the structure of each of the mating main holding portion 580, the mating power terminals 590, the mating sub-housing 60 and the mating detection terminals 690 is not specifically limited, provided that the mating housing 18 can hold the mating power terminals 590 and the mating detection terminals 690.

Referring to FIG. 3 together with FIG. 2, the two mating power terminals 590 are connected to power cables 820, respectively. Each of the power cables 820 is attached to a round terminal 830 made of metal. Thus, for each of the power cables 820, an upper end (positive Z-side end) thereof is connected to the mating power terminal 590, and a lower end (negative Z-side end) thereof is connected to the round terminal 830. The two mating detection terminals 690 (see FIG. 4) are connected to signal cables 840, respectively. Thus, for each of the signal cables 840, an upper end thereof is connected to the mating detection terminal 690.

The two round terminals 830 are electrically connected with the power system (not shown) and the motor (not shown). When the two mating power terminals 590 are connected to each other, and the two mating detection terminals 690 are connected to each other, the control by the power system makes electric current flow through the mating power terminals 590 via the power cables 820.

As shown in FIGS. 4 to 6, the mating housing 18 is provided with two mating axis portions (pivot shafts) 520. The mating axis portions 520 of the present embodiment are formed on the mating main housing 50 and are located in the receiving portion 52. Each of the mating axis portions 520 is a pivot shaft which has a cylindrical shape extending in an axial direction in parallel to the Y-direction. The mating axis portions 520 are provided so as to correspond to the two side walls 516, respectively. The mating axis portions 520 are located at positions same as each other in a vertical plane (XZ-plane) defined by the X-direction and the Z-direction. The two mating axis portions 520 put the mating main holding portion 580 therebetween in the Y-direction. In detail, the mating main holding portion 580 has opposite outer surfaces in the Y-direction. Each of the side walls 516 has an inner surface in the Y-direction. Each of the mating axis portions 520 extends along the Y-direction from one of the outer surfaces of the mating main holding portion 580 to the inner surface of the corresponding side wall 516.

The mating housing 18 is provided with two mating guide portions 522. The mating guide portions 522 of the present embodiment are formed on the mating main housing 50 and are located in the receiving portion 52. Each of the mating guide portions 522 is a projection which has a cylindrical shape projecting in the Y-direction. The mating guide portions 522 are provided so as to correspond to the two side walls 516, respectively. The mating guide portions 522 are located at positions same as each other in the XZ-plane. The two mating guide portions 522 put the mating main holding portion 580 therebetween in the Y-direction. Each of the mating guide portions 522 projects inward in the Y-direction from the inner surface of the corresponding side wall 516.

Referring to FIGS. 4 to 6, the mating housing 18 is provided with two first regulation portions 552, two second regulation portions 554 and two catch portions 556. Each of the first regulation portions 552, the second regulation portions 554 and the catch portions 556 of the present embodiment is formed on the front wall 511 of the mating main housing 50.

In detail, the front wall 511 has a protruding portion 512. The protruding portion 512 is located at the middle of the front wall 511 in the Y-direction and protrudes forward. The protruding portion 512 has opposite sides in the Y-direction which are formed with two corner portions 513, respectively. Each of the corner portions 513 has a flat-plate shape in parallel to a horizontal plane (XY-plane) perpendicular to the Z-direction and is located above the receiving portion 52. Each of the corner portions 513 has an upper surface (positive Z-side surface) which has a front side surface (positive X-side surface) and a rear side surface (negative X-side surface). The front side surface of each of the corner portions 513 extends along the XY-plane. The rear side surface of each of the corner portions 513 is a sloping surface which is oblique to the Z-direction. In detail, each of the rear side surfaces extends in the negative X-direction and in the negative Z-direction from a rear end of the front side surface. More specifically, each of the rear side surfaces extends rearward and downward from a rear end of the front side surface.

Each of the first regulation portions 552 of the present embodiment is a part of an upper surface of the protruding portion 512 of the front wall 511. The first regulation portions 552 are located at opposite sides of the protruding portion 512 in the Y-direction, respectively. Each of the first regulation portions 552 extends along the XY-plane and faces upward. The second regulation portions 554 of the present embodiment are parts of lower surfaces (negative Z-side surfaces) of the corner portions 513, respectively. Each of the second regulation portions 554 extends along the XY-plane and faces downward. The catch portions 556 of the present embodiment are parts of the rear side surfaces of the corner portions 513, respectively. Each of the catch portions 556 is a sloping surface which extends rearward and downward. Each of the catch portions 556 faces upward and rearward.

Referring to FIG. 5, the mating housing 18 is provided with two mating lock portions 532. Each of the mating lock portions 532 of the present embodiment is a part of the front wall 511 of the mating main housing 50. In detail, the protruding portion 512 of the front wall 511 is formed with two recessed portions 530. The two recessed portions 530 are arranged in the Y-direction. Each of the recessed portions 530 is a recess which is recessed rearward. Each of the recessed portions 530 has an inner wall surface which is located on an upper side (positive Z-side) thereof and extends along the XY-plane. The mating lock portions 532 of the present embodiment are formed so as to correspond to the recessed portions 530, respectively. More specifically, each of the mating lock portions 532 is a part of the inner wall surface which is located on the upper side of the corresponding recessed portion 530. Each of the mating lock portions 532 extends along the XY-plane and faces downward.

The mating housing 18 is provided with a maintaining portion 558. The maintaining portion 558 of the present embodiment is a front surface (positive X-side surface) of the protruding portion 512 of the front wall 511. The maintaining portion 558 faces forward.

Referring to FIGS. 4 to 6, the mating housing 18 is provided with two connection-guide portions 562. In detail, the bottom portion 518 of the mating main housing 50 is formed with two guide plates 560. The guide plates 560 are located on opposite sides of the mating sub-housing 60 in the Y-direction, respectively. Each of the guide plates 560 has a flat-plate shape in parallel to the XZ-plane and extends upward from the bottom portion 518. The connection-guide portions 562 are provided so as to correspond to the guide plates 560, respectively. The connection-guide portions 562 are located at positions same as each other in the XZ-plane. Each of the connection-guide portions 562 protrudes outward in the Y-direction from the corresponding guide plate 560 and linearly extends along the Z-direction. Each of the connection-guide portions 562 is located in the receiving portion 52.

Summarizing the explanation described above, the mating housing 18 of the present embodiment is provided with the two first regulation portions 552, the two second regulation portions 554, the two catch portions 556, the two mating lock portions 532, the maintaining portion 558 and the two connection-guide portions 562. Each of these portions has the aforementioned structure and is arranged as described above. However, the present invention is not limited thereto. For example, the number, the structure and the arrangement of each of these portions can be modified as necessary. For example, the number of the first regulation portions 552 may be one or may be three or more. Each of the catch portions 556, the mating lock portions 532, the maintaining portion 558 and the connection-guide portions 562 may be provided as necessary.

Figure 24:
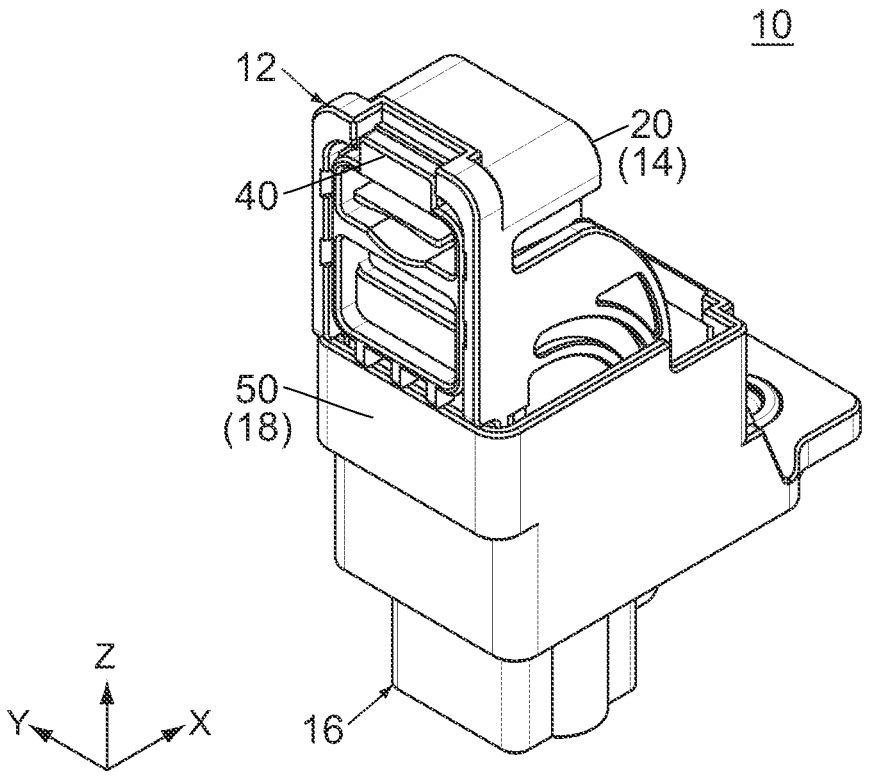
FIG. 24 is a perspective view showing the connector device of FIG. 2, wherein the connector is located at an open position, the slider is located at a first position, and the power cables and the signal cables are not illustrated.
Figure 25:
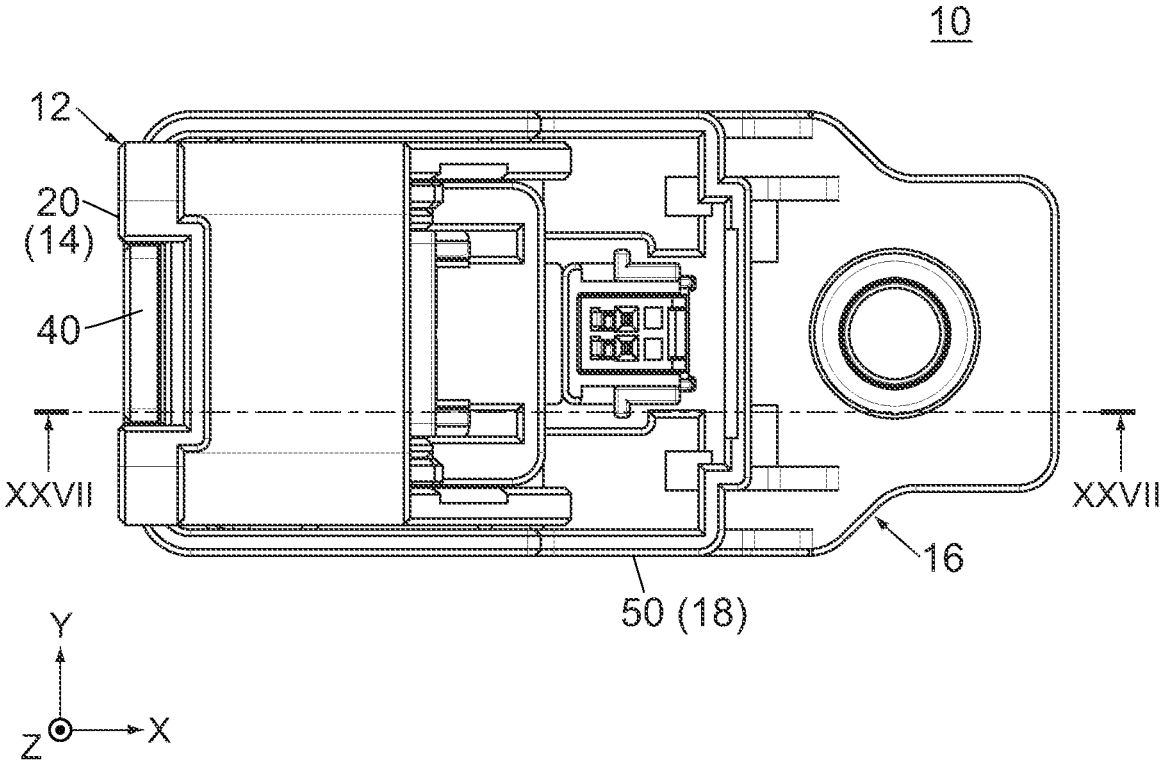
FIG. 25 is a top view showing the connector device of FIG. 24.
Figure 38:
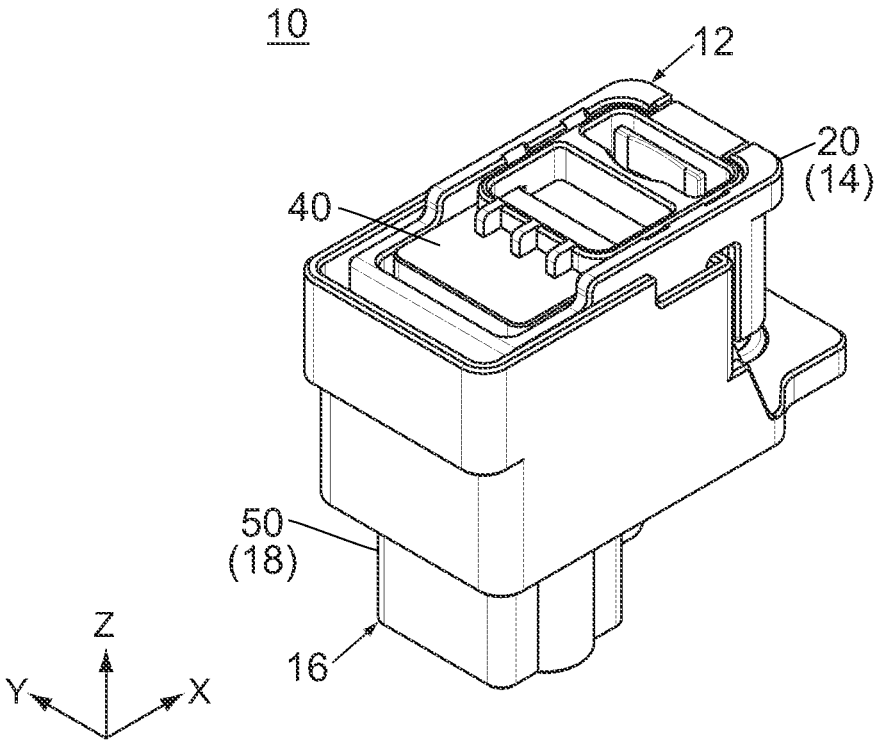
FIG. 38 is a perspective view showing the connector device of FIG. 28, wherein the connector is located at the closed position, the slider is located at the second position, and the power cables and the signal cables are not illustrated.
Figure 39:
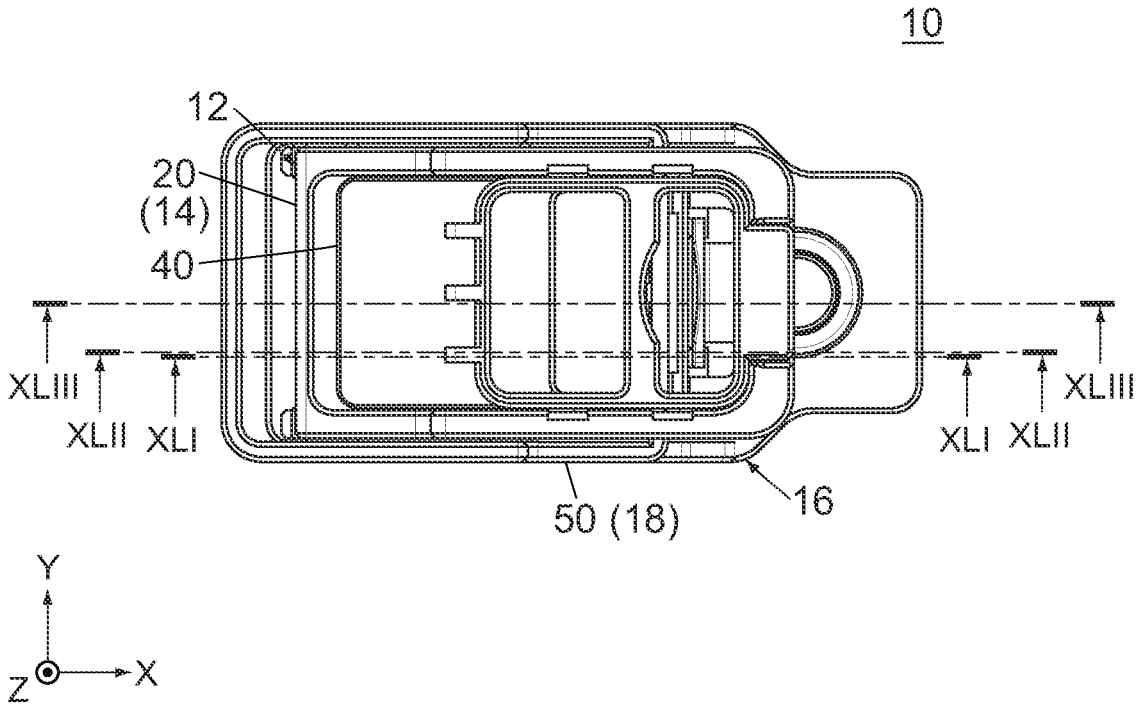
FIG. 39 is a top view showing the connector device of FIG. 38.

Hereafter, explanation will be made about the connector 12 (see FIG. 7) of the present embodiment. Referring to FIGS. 2, 24 and 38, the connector 12 changes its position relative to the mating connector 16 in accordance with the mating operation of the connector device 10. The connector 12 changes its posture in the XZ-plane in accordance with this change of the position of the connector 12. Therefore, each portion of the connector 12 changes its positional relation relative to the whole connector 12 in the XZ-plane. In the explanation described below, the position of each portion of the connector 12 in the XZ-plane is a position relative to the connector 12 which is located at a closed position shown in FIGS. 2 and 38 unless otherwise noted.

Referring to FIGS. 8, 9, 12 and 13, the connector 12 of the present embodiment comprises a housing 14, a power terminal 290 made of metal, a detection terminal 390 made of metal and a slider 40 made of insulator. The housing 14 comprises a main housing 20 made of insulator and a sub-housing 30 made of insulator. However, the present invention is not limited thereto. For example, the main housing 20 and the sub-housing 30 may be integral to each other. In other words, each of the main housing 20 and the sub-housing 30 may be a part of the unitary housing 14. Instead, the connector 12 may comprise another member in addition to the aforementioned members.

Figure 14:
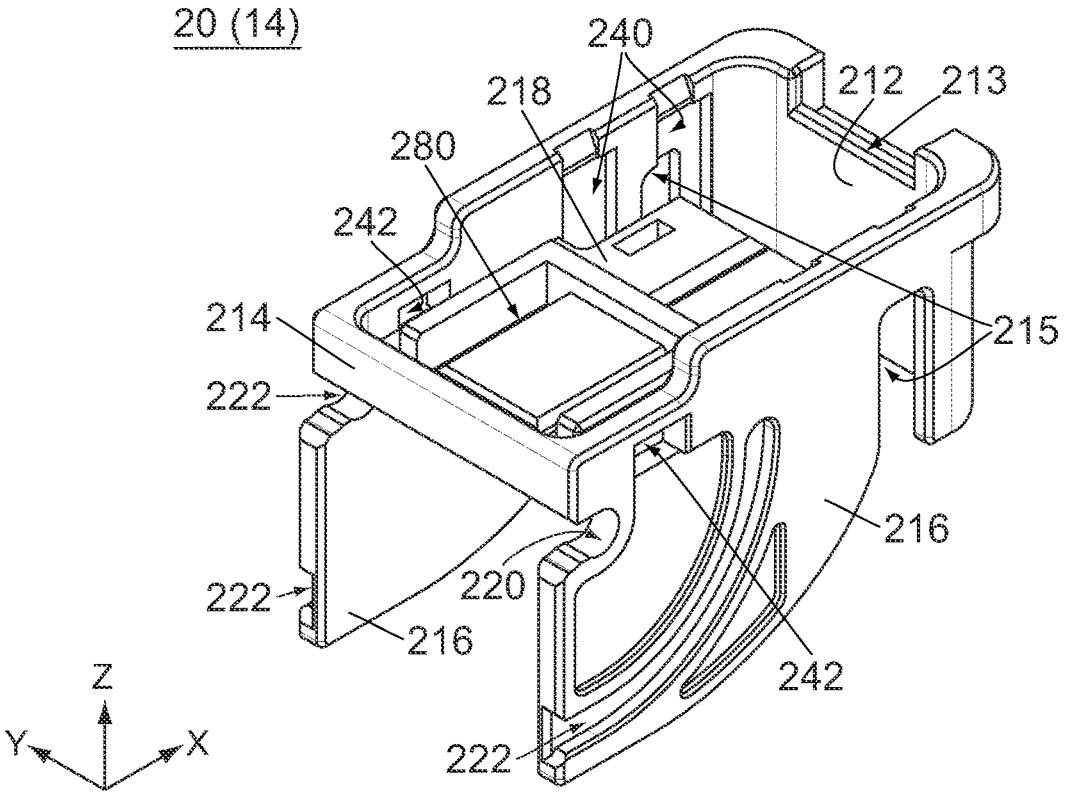
FIG. 14 is a perspective view showing a main housing of the connector of FIG. 13.
Figure 15:
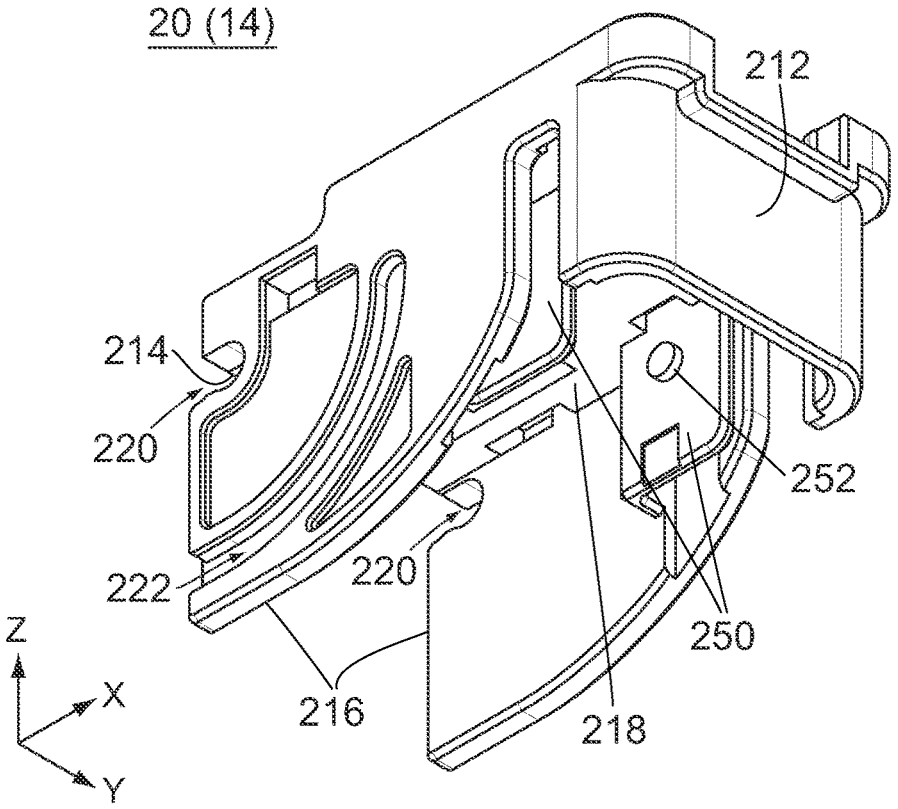
FIG. 15 is another perspective view showing the main housing of FIG. 14.
Figure 16:
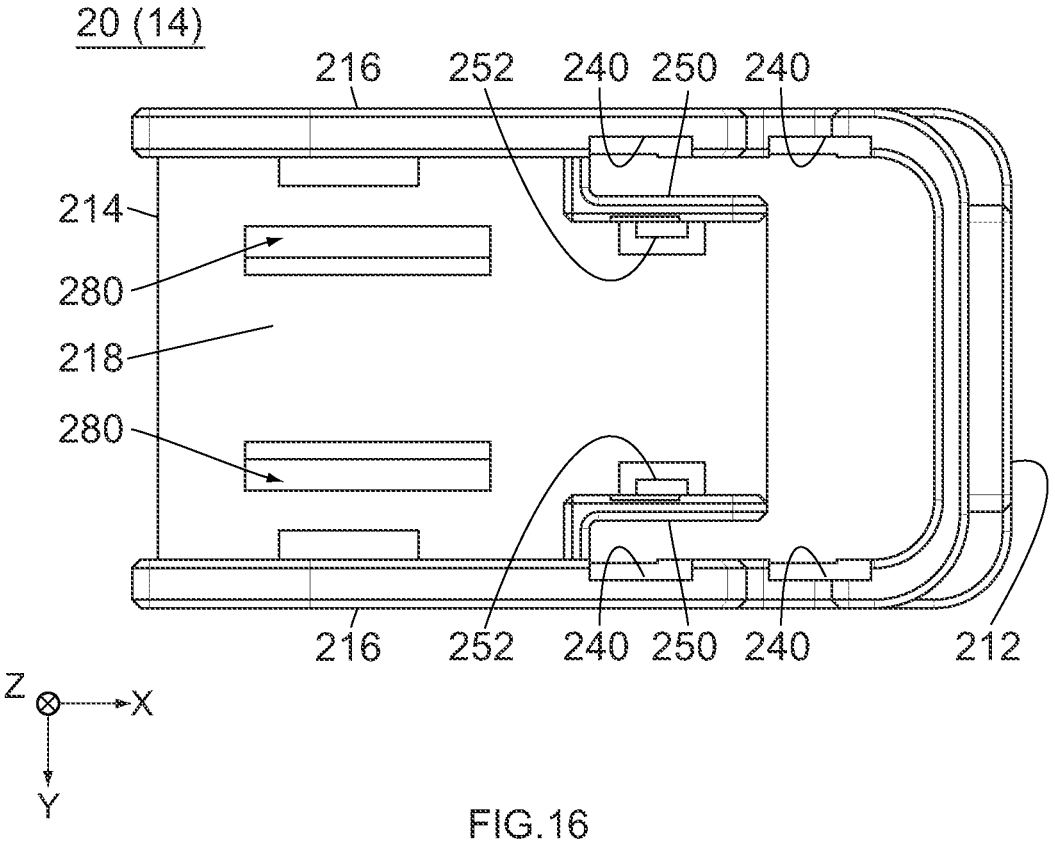
FIG. 16 is a bottom view showing the main housing of FIG. 14.

As shown in FIGS. 14 to 16, the main housing 20 has a base portion 212, an opposite portion 214, two side plates 216 and a support plate 218. The side plates 216 are located at opposite sides of the main housing 20 in the Y-direction, respectively. Each of the side plates 216 extends in parallel to the XZ-plane. The base portion 212 is located at a front end (positive X-side end) of the main housing 20. The base portion 212 couples the two side plates 216 to each other in the Y-direction. The opposite portion 214 is located in the vicinity of a rear end of the main housing 20. The opposite portion 214 couples the two side plates 216 to each other in the Y-direction. The support plate 218 is located at an upper side of the main housing 20. The support plate 218 extends in parallel to the XY-plane and couples the two side plates 216 to each other in the Y-direction.

Referring to FIG. 14, the main housing 20 has an indent 213 and two windows 215. The indent 213 is a recess formed in the base portion 212. The indent 213 is located at the middle of the base portion 212 in the Y-direction. The indent 213 is recessed downward from an upper end of the base portion 212. The windows 215 are cuts which are provided so as to correspond to the two side plates 216, respectively. Each of the windows 215 is located between the base portion 212 and the corresponding side plate 216 in the X-direction. Referring to FIGS. 14 and 16, the main housing 20 has two main holding portions 280. Each of the main holding portions 280 of the present embodiment is a hole formed in the support plate 218. Each of the main holding portions 280 passes through the support plate 218 in the Z-direction.

The main housing 20 of the present embodiment has the aforementioned basic structure. However, the present invention is not limited thereto, but the basic structure of the main housing 20 can be modified as necessary.

Figure 9:
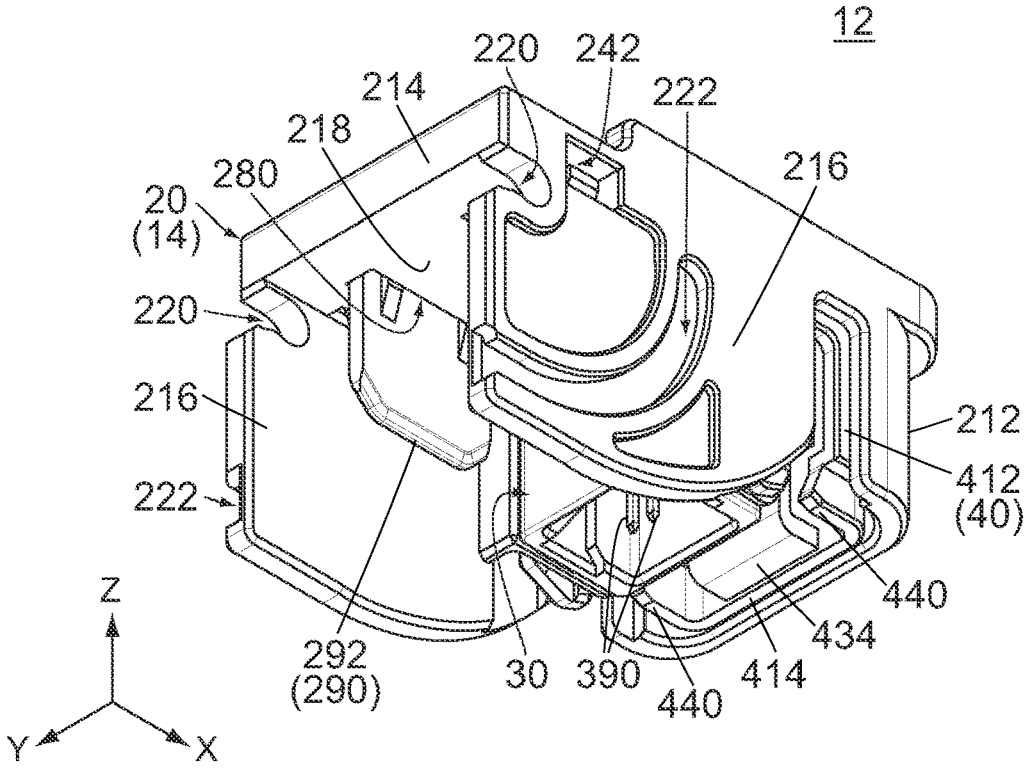
FIG. 9 is still another perspective view showing the connector of FIG. 7.
Figure 12:
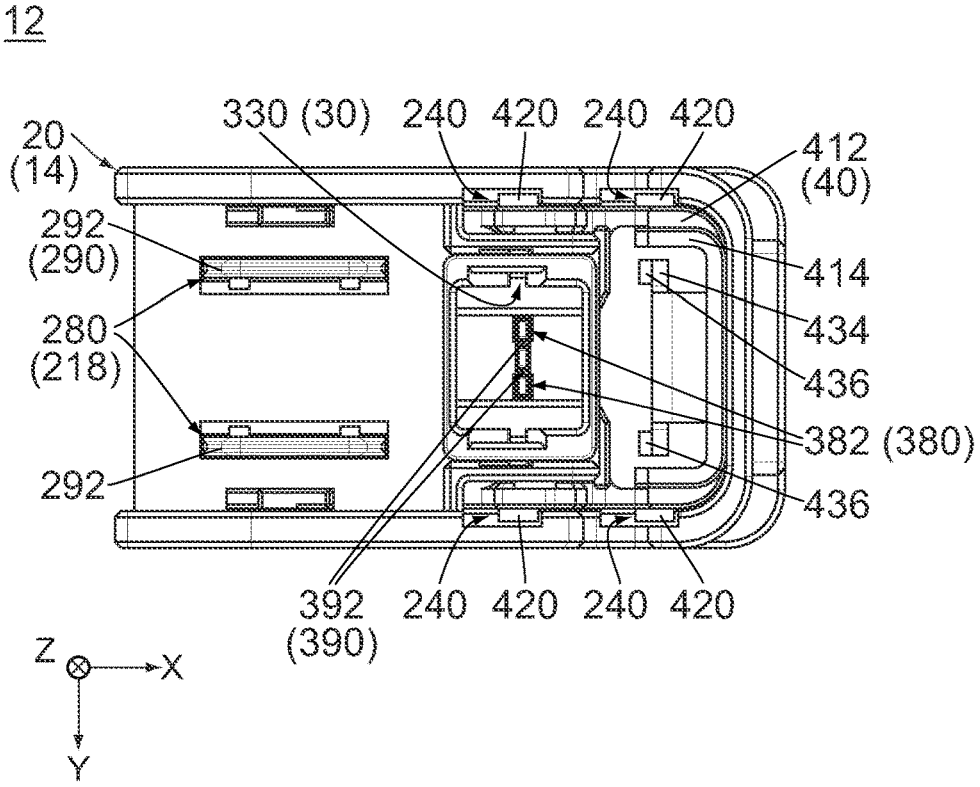
FIG. 12 is a bottom view showing the connector of FIG. 7.
Figure 13:
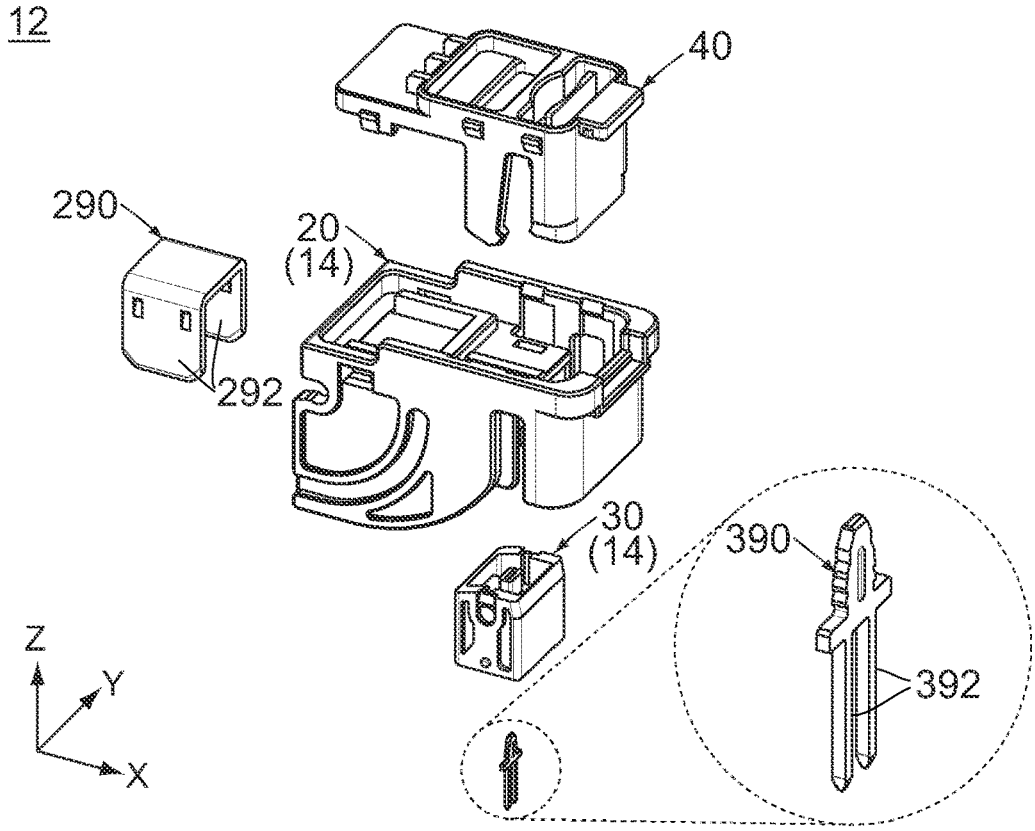
FIG. 13 is an exploded, perspective view showing the connector of FIG. 7, wherein a detection terminal is enlarged and illustrated.

As shown in FIG. 13, the power terminal 290 has two blades 292 which are arranged in the Y-direction. Referring to FIGS. 9 and 12, the main holding portions 280 hold the power terminal 290. In detail, the blades 292 of the power terminal 290 are inserted into the main holding portions 280, respectively, and are engaged with the main holding portions 280, respectively. Thus, the power terminal 290 is held by the main housing 20 and is fixed to the main housing 20 so as to be unmovable relative to the main housing 20. As described above, each of the main holding portions 280 of the present embodiment is a hole which receives the blade 292 of the power terminal 290. However, the structure of each of the main holding portions 280 and the power terminal 290 is not specifically limited, provided that the housing 14 can hold the power terminal 290.

As shown in FIGS. 14 and 15, the housing 14 is provided with two axis portions (bearings) 220. The axis portions 220 of the present embodiment are provided to the main housing 20. The axis portions 220 are provided so as to correspond to the two side plates 216, respectively. Each of the axis portions 220 is a hole which works as a bearing. Each of the axis portions 220 passes through the corresponding side plate 216 in the Y-direction and opens rearward. The two axis portions 220 are located at positions same as each other in the XZ-plane.

Figure 7:
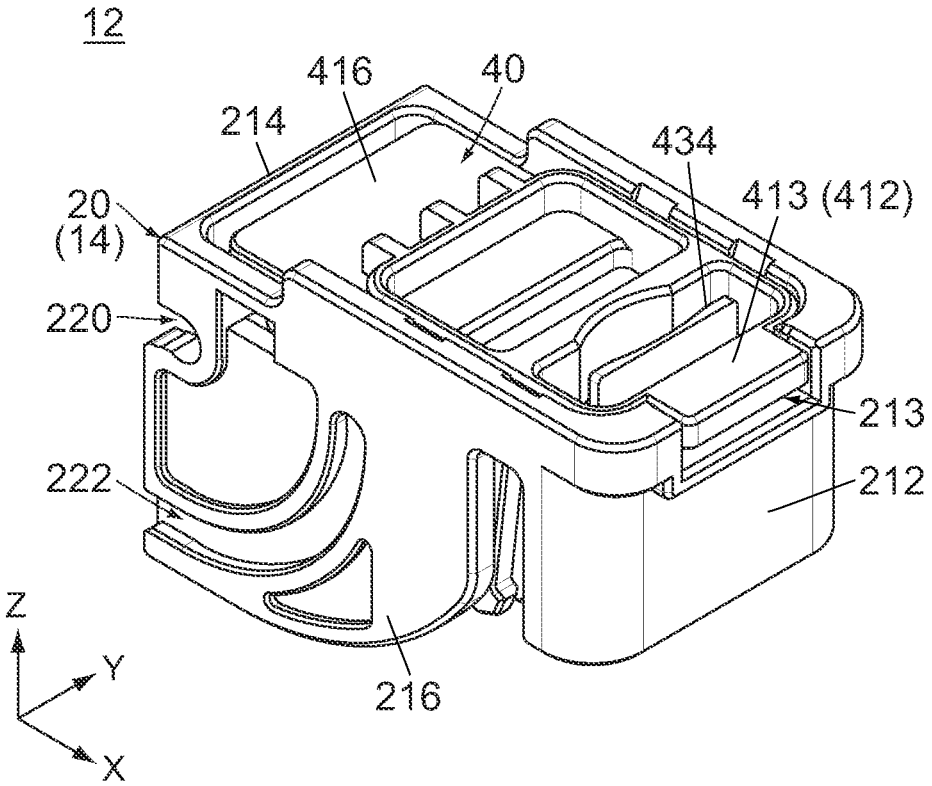
FIG. 7 is a perspective view showing the connector of FIG. 1, wherein the slider is located at a second position.
Figure 26:
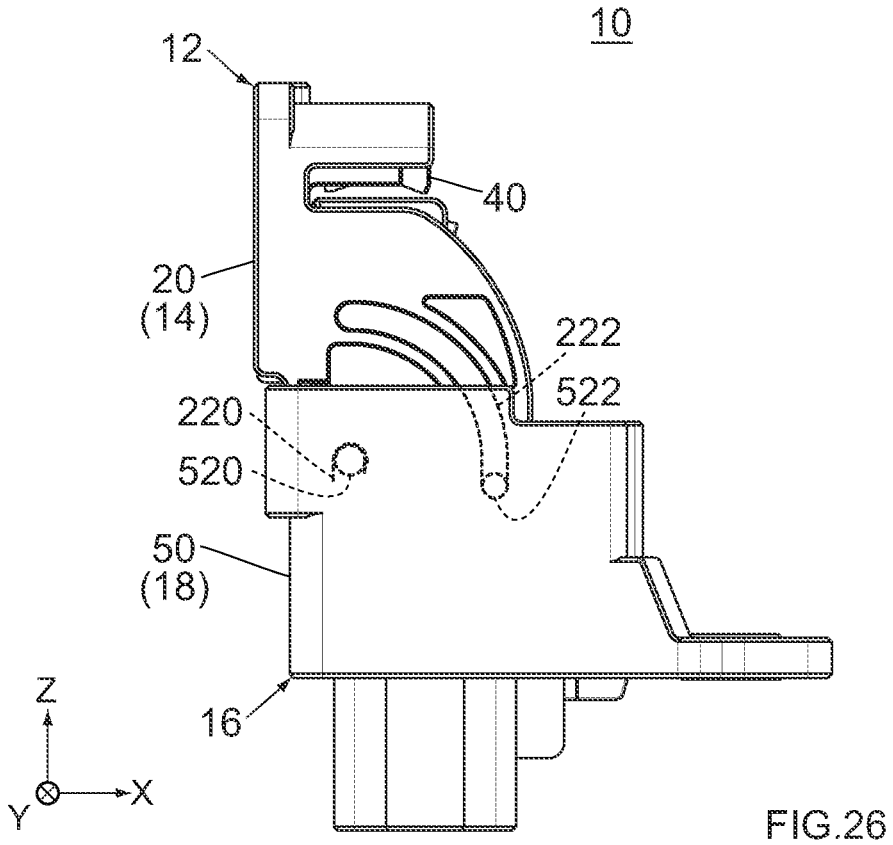
FIG. 26 is a side view showing the connector device of FIG. 24, wherein outlines of a hidden axis portion and a hidden guide portion of the connector and outlines of a hidden mating axis portion and a hidden mating guide portion of the mating connector are illustrated with dashed line.

Referring to FIG. 26 together with FIGS. 5 and 7, the connector 12 of the present embodiment is turnable about the mating axis portions 520 and the axis portions 220 when the mating axis portions 520 of the mating connector 16 are combined to the axis portions 220, respectively. As can be seen from FIGS. 24, 28 and 38, when the axis portions 220 (see FIG. 26) are combined to the mating axis portions 520 (see FIG. 26), respectively, the connector 12 is turnable about the pivot shafts (mating axis portions) 520 between an open position shown in FIG. 24 and the closed position shown in FIG. 38 via a predetermined position shown in FIG. 28.

When the connector 12 is located between the open position and the closed position, the connector 12 is located at an upper side of the mating connector 16 in the upper-lower direction (Z-direction) perpendicular to the axial direction of the pivot shafts 520. The connector 12 which is located at the open position is removable from the mating connector 16. The connector 12 which is located at the closed position takes the mated state where the connector 12 is completely mated with the mating connector 16.

Referring to FIGS. 5 and 7, according to the present embodiment, the axis portions 220 of the connector 12 are bearings, and the mating axis portions 520 of the mating connector 16 are pivot shafts. However, the present invention is not limited thereto. For example, the axis portions 220 may be pivot shafts, and the mating axis portions 520 may be bearings. Thus, one of the axis portion 220 and the mating axis portion 520 should be a pivot shaft, and a remaining one of the axis portion 220 and the mating axis portion 520 should be a bearing.

Figure 28:
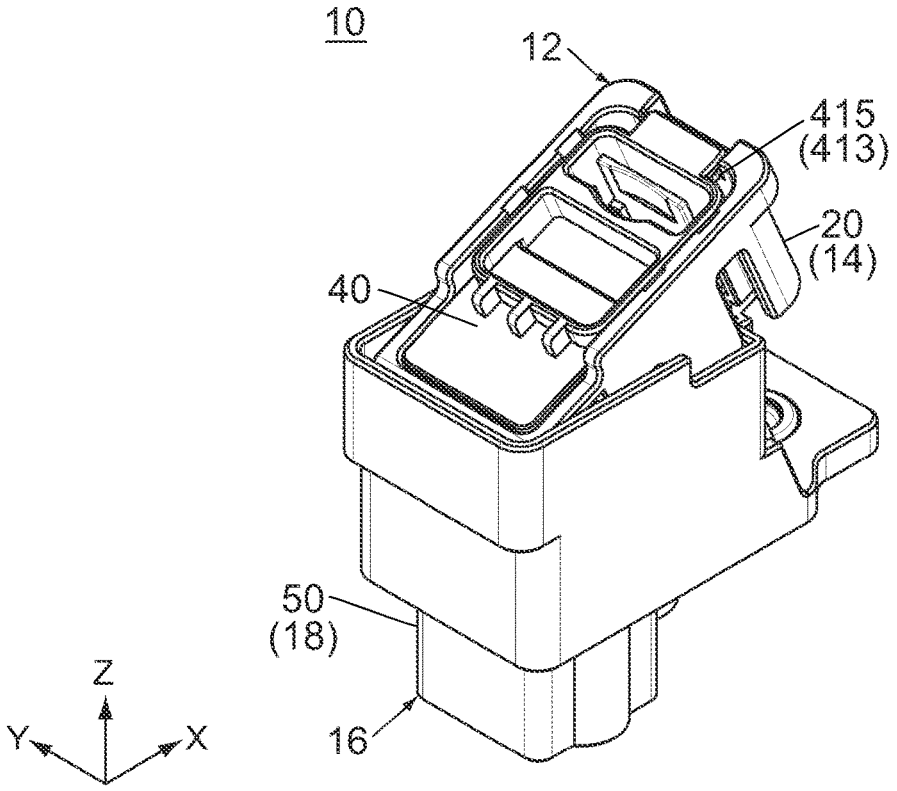
FIG. 28 is a perspective view showing the connector device of FIG. 24, wherein the connector is located at the predetermined position, the slider is located at the first position, and the power cables and the signal cables are not illustrated.
Figure 29:
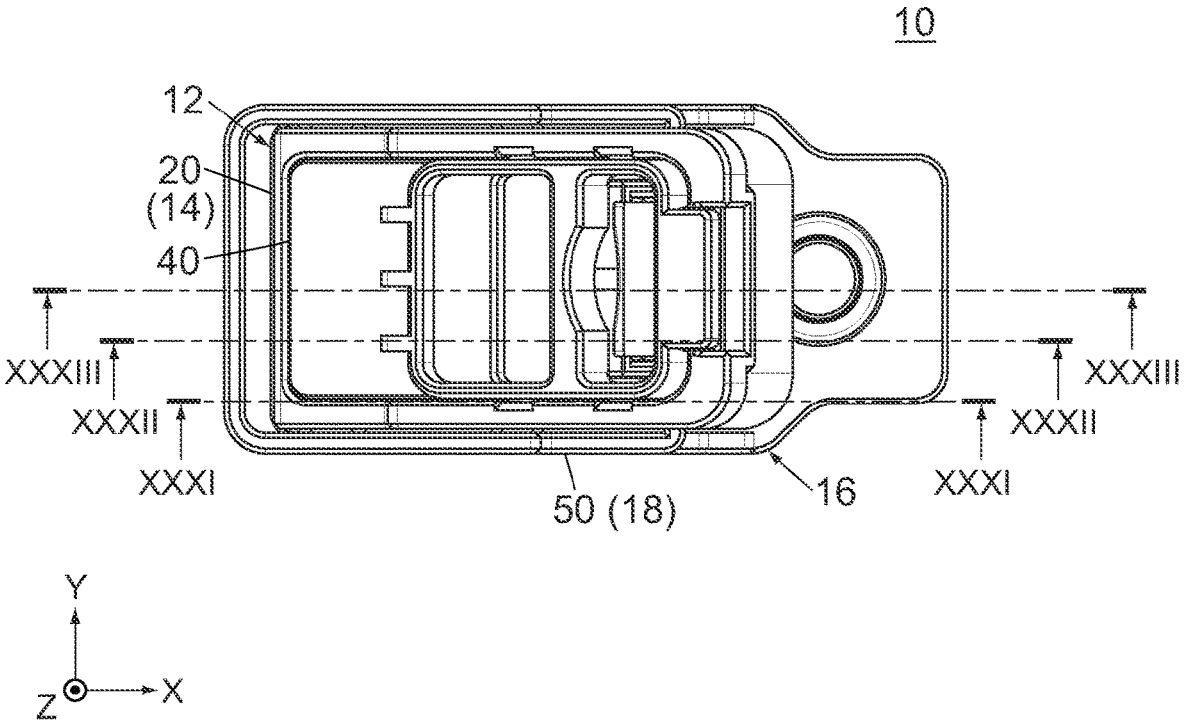
FIG. 29 is a top view showing the connector device of FIG. 28.

As can be seen from FIGS. 24, 28 and 38, the position of each portion of the connector 12 in the XZ-plane is changed in accordance with the turning movement of the connector 12. In the explanation described below, the position of each portion of the connector 12 in the XZ-plane is a position relative to the connector 12 which is located at the closed position shown in FIG. 38 similarly to the explanation described above.

As shown in FIGS. 14 and 15, the housing 14 is provided with two guide portions 222. The guide portions 222 of the present embodiment are provided to the main housing 20. The guide portions 222 are provided so as to correspond to the two side plates 216, respectively. Each of the guide portions 222 is a channel formed in an outer surface of the corresponding side plate 216 in the Y-direction and is recessed inward in the Y-direction. Each of the guide portions 222 has an arc shape which extends about the axis portion 220 in the XZ-plane. Each of the guide portions 222 opens at a rear end of the corresponding side plate 216. The two guide portions 222 are located at positions same as each other in the XZ-plane.

Figure 40:
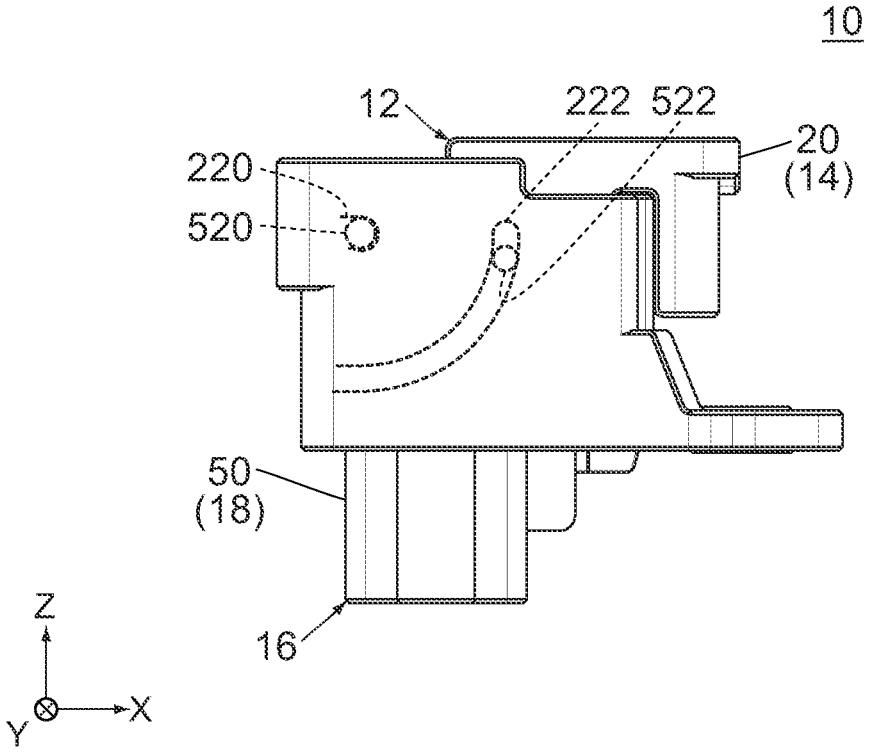
FIG. 40 is a side view showing the connector device of FIG. 38, wherein the power cables and the signal cables are not illustrated, and outlines of a hidden axis portion and a hidden guide portion of the connector and outlines of a hidden mating axis portion and a hidden mating guide portion of the mating connector are illustrated with dashed line.

Referring to FIG. 26 together with FIGS. 5 and 7, when the mating axis portions 520 are combined to the axis portions 220, the mating guide portions 522 are received in the guide portions 222, respectively. Referring to FIGS. 26 and 40, the guide portions 222 and the mating guide portions 522 guide a movement of the connector 12 between the open position shown in FIG. 26 and the closed position shown in FIG. 40.

More specifically, during the turning movement of the connector 12 between the open position and the closed position, the mating guide portions 522 are continuously received in the channels of the guide portions 222, respectively, and are moved along the channels of the guide portions 222, respectively. This mechanism prevents the mating axis portions 520 from coming off the axis portions 220 during the turning movement of the connector 12. Thus, the guide portions 222 and the mating guide portions 522 of the present embodiment enable easy operation of the connector 12 upon the turning movement of the connector 12. However, the present invention is not limited thereto. For example, the guide portions 222 and the mating guide portions 522 may be provided as necessary.

As shown in FIGS. 14 and 16, the housing 14 is provided with four slider-guide portions 240 and two slider-support portions 242. The slider-guide portions 240 and the slider-support portions 242 of the present embodiment are provided to the main housing 20. More specifically, each of the side plates 216 of the present embodiment is formed with two of the slider-guide portions 240 and one of the slider-support portions 242.

Each of the slider-guide portions 240 is a recess formed in an inner surface of the side plate 216 in the Y-direction. Each of the slider-guide portions 240 is recessed outward in the Y-direction from the inner surface of the side plate 216. Each of the slider-guide portions 240 is formed with an inner wall surface which is located on an upper side thereof. Each of the inner wall surfaces, which is located on the upper side of the slider-guide portion 240, faces downward. Each of the slider-support portions 242 is a hole formed in the side plate 216. Each of the slider-support portions 242 passes through the side plate 216 in the Y-direction. In each of the side plates 216, the two slider-guide portions 240 and the slider-support portion 242 are arranged in the X-direction. The slider-guide portions 240 and the slider-support portion 242 of one of the side plates 216 are located at positions same as those of the slider-guide portions 240 and the slider-support portion 242 of a remaining one of the side plates 216 in the XZ-plane.

As shown in FIGS. 15 and 16, the housing 14 is provided with two sub-axis portions (pivot shafts) 252. In detail, the support plate 218 of the main housing 20 is formed with two axis-support portions 250. The axis-support portions 250 are located at opposite sides of the support plate 218 in the Y-direction, respectively. Each of the axis-support portions 250 has a flat-plate shape in parallel to the XZ-plane and extends downward from the support plate 218. The sub-axis portions 252 are provided so as to correspond to the axis-support portions 250, respectively. The sub-axis portions 252 are located at positions same as each other in the XZ-plane. Each of the sub-axis portions 252 is a projection which has a cylindrical shape projecting inward in the Y-direction from the corresponding axis-support portion 250. The two sub-axis portions 252 project toward each other in the Y-direction.

Summarizing the explanation described above, the housing 14 of the present embodiment is provided with the four slider-guide portions 240, the two slider-support portions 242 and the two sub-axis portions 252. Each of these portions has the aforementioned structure and is arranged as described above. However, the present invention is not limited thereto. For example, the number, the structure and the arrangement of each of these portions can be modified as necessary. For example, the sub-axis portions 252 may be provided as necessary.

Figure 21:
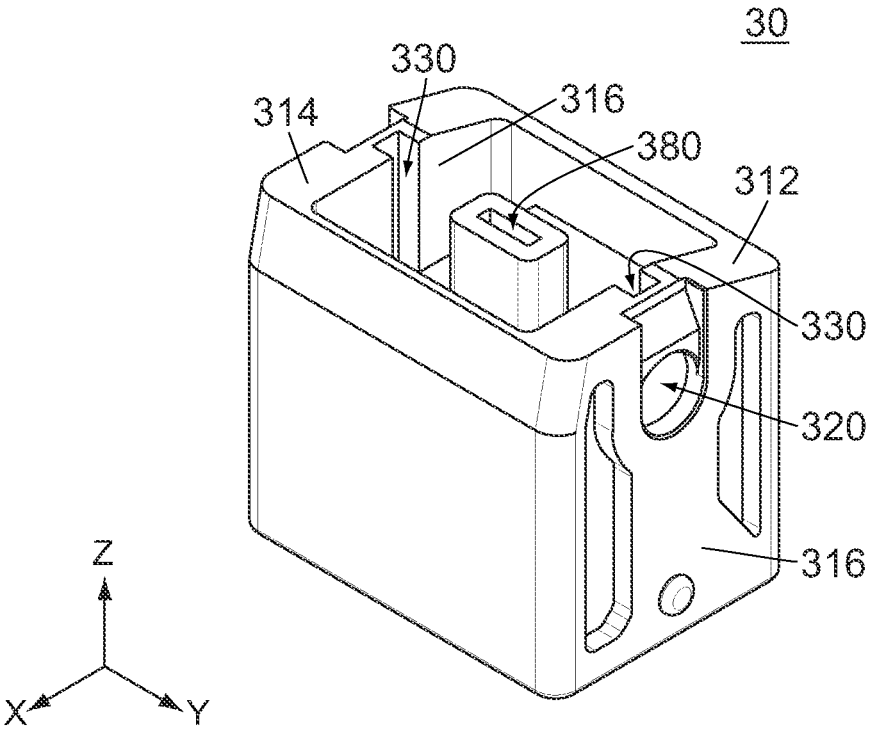
FIG. 21 is a perspective view showing a sub-housing of the connector of FIG. 13.
Figure 22:
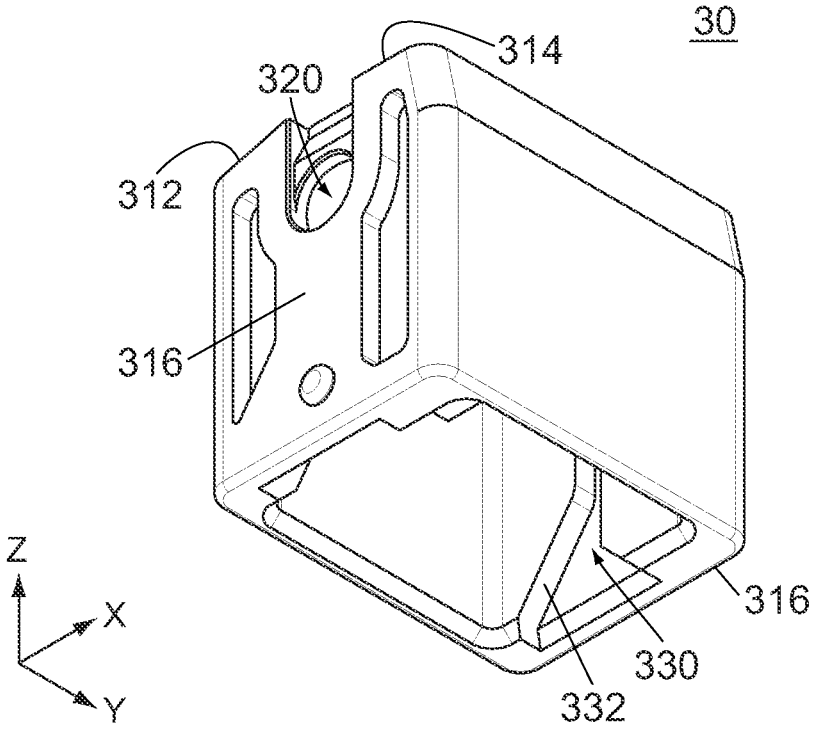
FIG. 22 is another perspective view showing the sub-housing of FIG. 21.

As shown in FIGS. 21 and 22, the sub-housing 30 has a rectangular parallelepiped shape. The sub-housing 30 has a first abutment surface 312, a second abutment surface 314 and two side walls 316. The first abutment surface 312 is a rear part of an upper surface of the sub-housing 30. The second abutment surface 314 is a front part of the upper surface of the sub-housing 30. The second abutment surface 314 extends in parallel to the XY-plane. The first abutment surface 312 is a sloping surface which is oblique to the Z-direction. In detail, the first abutment surface 312 extends downward and rearward from a rear end of the second abutment surface 314. The side walls 316 are located at opposite sides of the sub-housing 30 in the Y-direction.

The sub-housing 30 of the present embodiment has the aforementioned basic structure. However, the present invention is not limited thereto, but the basic structure of the sub-housing 30 can be modified as necessary.

Figure 23:
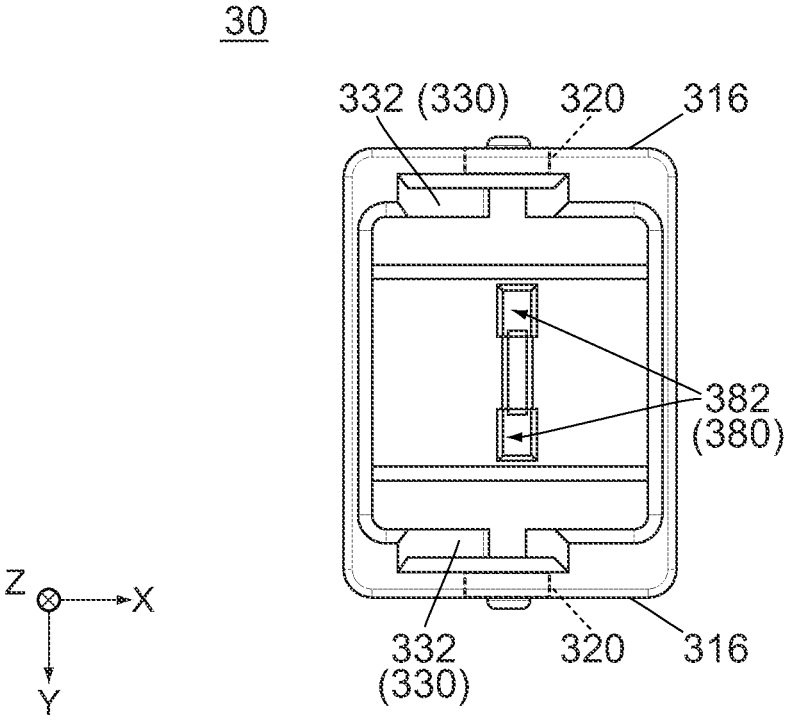
FIG. 23 is a bottom view showing the sub-housing of FIG. 21, wherein outlines of hidden bearings are illustrated with dashed line.

Referring to FIG. 21, the sub-housing 30 has a sub-holding portion 380. The sub-holding portion 380 of the present embodiment is a hole formed in the sub-housing 30. The sub-holding portion 380 opens upward and downward. Referring to FIG. 23, the sub-holding portion 380 is formed with two sub-holding holes 382. Each of the sub-holding holes 382 extends downward from the sub-holding portion 380 and opens downward. Referring to FIG. 12 together with FIG. 21, the sub-holding portion 380 holds the detection terminal 390.

Figure 8:
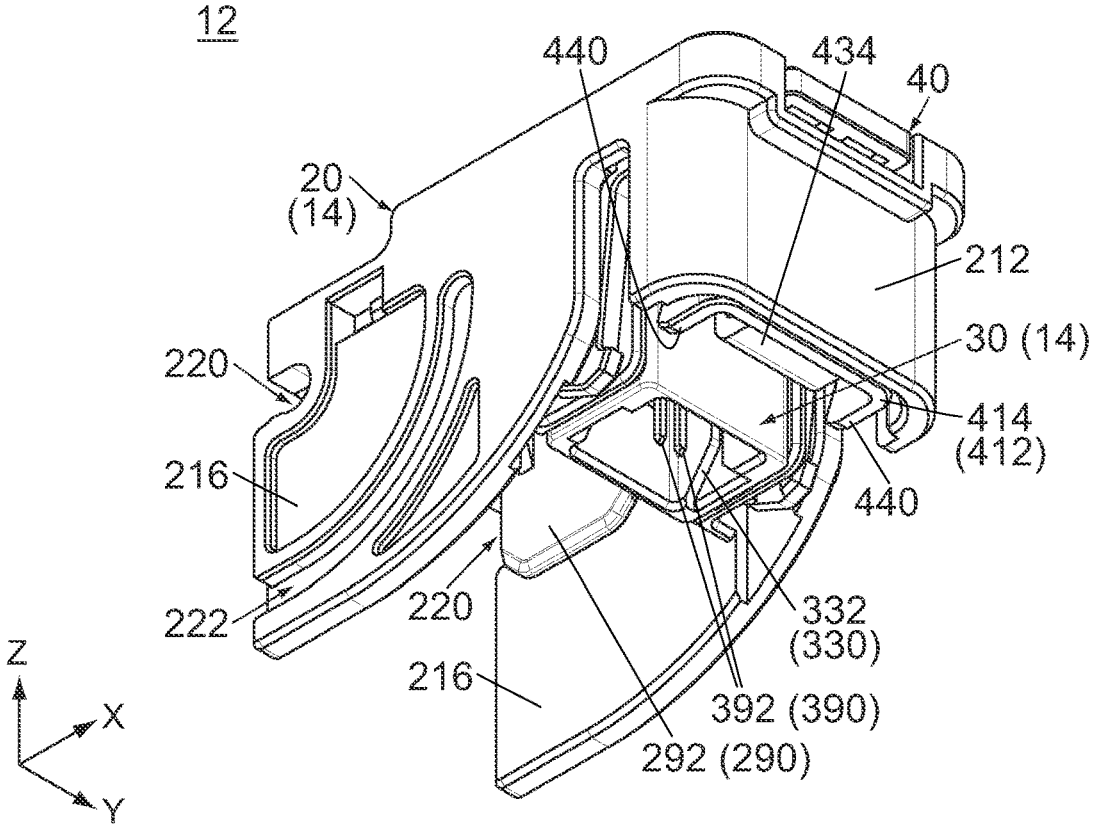
FIG. 8 is another perspective view showing the connector of FIG. 7.

In detail, referring to FIG. 13, the detection terminal 390 has two pin terminals 392 which are arranged in the Y-direction. Referring to FIGS. 21 and 23 together with FIG. 12, the detection terminal 390 is press-fit into the sub-holding portion 380, and the pin terminals 392 are received in the sub-holding holes 382, respectively. Referring to FIG. 8 together with FIG. 23, the pin terminals 392 extend downward through the sub-holding holes 382. The thus-located detection terminal 390 is held by the sub-housing 30 and is fixed to the sub-housing 30 so as to be unmovable relative to the sub-housing. As described above, the sub-holding portion 380 of the present embodiment is a hole for receiving the detection terminal 390. However, the structure of each of the sub-holding portion 380 and the detection terminal 390 is not specifically limited, provided that the housing 14 can hold the detection terminal 390.

Referring to FIG. 12, the power terminal 290 of the present embodiment is held by the main housing 20 of the housing 14, and the detection terminal 390 of the present embodiment is held by the sub-housing 30 of the housing 14. However, the present invention is not limited thereto, but the power terminal 290 and the detection terminal 390 should be held by the housing 14.

Referring to FIGS. 21 and 22, the sub-housing 30 is provided with two sub-axis portions (bearings) 320. The sub-axis portions 320 are provided so as to correspond to the two side walls 316, respectively. Each of the axis portions 220 is a recess which works as a bearing. Each of the axis portions 220 is formed in an outer surface of the corresponding side wall 316 in the Y-direction and is recessed inward in the Y-direction. Each of the axis portions 220 has a circular shape in the XZ-plane. The two sub-axis portions 320 are located at positions same as each other in the XZ-plane.

Referring to FIGS. 21 to 23, the sub-housing 30 is provided with two connection guided portions 330. The connection guided portions 330 are provided so as to correspond to the two side walls 316, respectively. Each of the connection guided portions 330 is a channel which is formed in an inner surface of the corresponding side wall 316 in the Y-direction. Each of the connection guided portions 330 is recessed outward in the Y-direction from the inner surface of the corresponding side wall 316 and opens upward and downward. The two connection guided portions 330 are located at positions same as each other in the XZ-plane.

Referring to FIGS. 22 and 23, each of the connection guided portions 330 is formed with a guided surface 332. Each of the guided surfaces 332 is an inner wall surface which is located on a rear side of the connection guided portion 330. Each of the guided surfaces 332 extends forward and upward and thereafter extends upward. In contrast, another inner wall surface which is located on a front side of the connection guided portion 330 extends straight along the Z-direction. Therefore, a lower part of each of the connection guided portions 330 extends downward while being widened in the X-direction. An upper part of each of the connection guided portions 330 linearly extends along the Z-direction.

Figure 27:
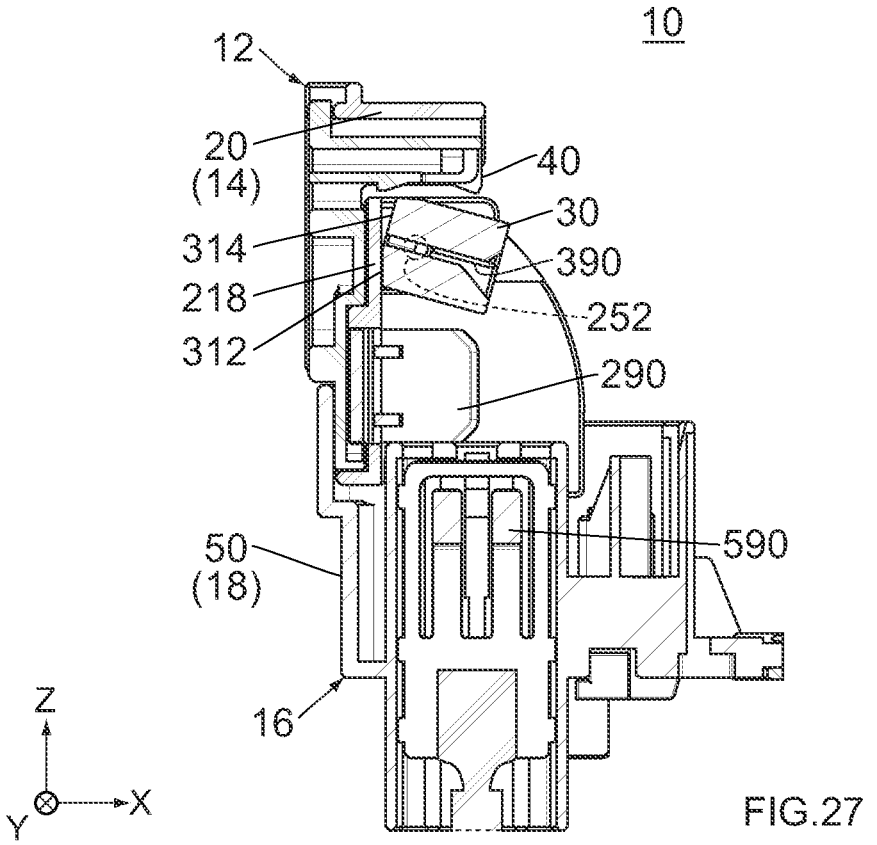
FIG. 27 is a cross-sectional view showing the connector device of FIG. 25, taken along line XXVII-XXVII, wherein an outline of a hidden sub-axis portion of the main housing is illustrated with dashed line, and the signal cable and a lower part of the power cable are not illustrated.

Referring to FIG. 8 together with FIGS. 16 and 21, the two sub-axis portions 252 of the main housing 20 are received in the two sub-axis portions 320 of the sub-housing 30, respectively. The thus-supported sub-housing 30 is turnable about the sub-axis portions (pivot shafts) 252 relative to the main housing 20. Referring to FIG. 27, the sub-housing 30 is turnable about the sub-axis portions 252 between a first limit position at which the first abutment surface 312 is brought into abutment with the support plate 218 of the main housing 20 and a second limit position at which the second abutment surface 314 is brought into abutment with the support plate 218.

As described above, the sub-housing 30 of the present embodiment is held by the main housing 20 to be swingable. However, the present invention is not limited thereto. For example, the sub-housing 30 may be provided as necessary. Even in an instance where the sub-housing 30 which is distinct from the main housing 20 is provided, the sub-housing 30 may be fixed to the main housing 20 so as to be unmovable relative to the main housing 20. In this instance, the sub-axis portions 252 of the main housing 20 and the sub-axis portions 320 of the sub-housing 30 do not need to be provided.

Figure 17:
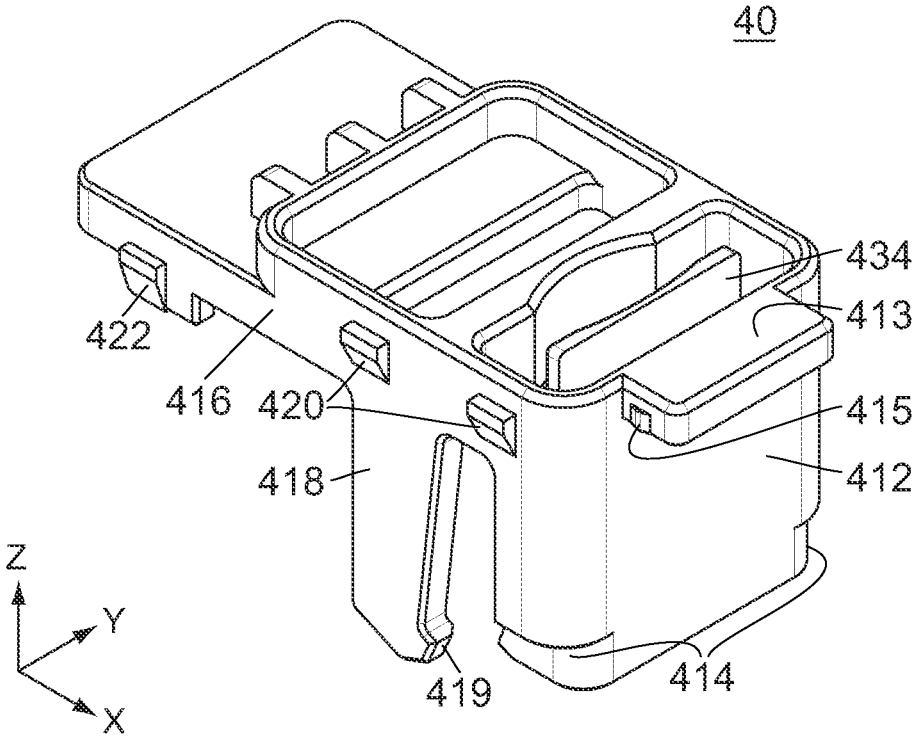
FIG. 17 is a perspective view showing the slider of the connector of FIG. 13.
Figure 18:
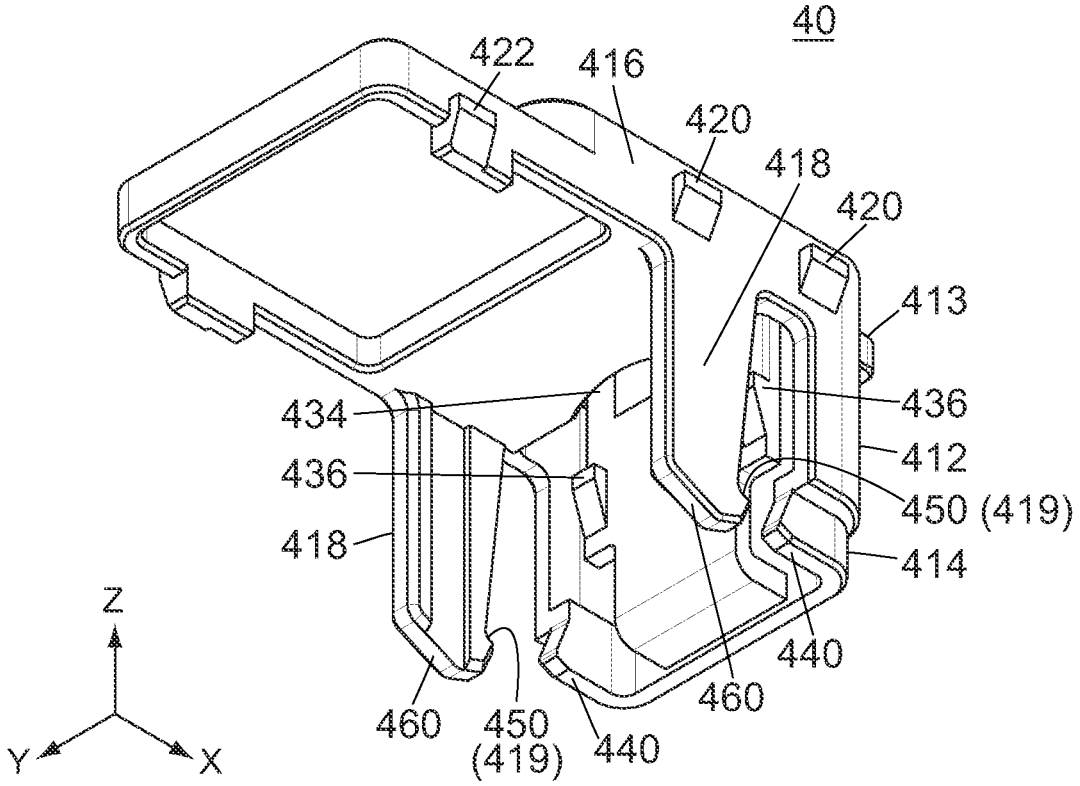
FIG. 18 is another perspective view showing the slider of FIG. 17.

As shown in FIGS. 17 and 18, the slider 40 has an end wall 412, a body 416 and two arms 418. The end wall 412 is located at a front end of the slider 40. The body 416 is located at an upper end of the slider 40 and extends in parallel to the XY-plane as a whole. The body 416 extends rearward from a rear end of the end wall 412. The arms 418 are located at opposite sides of the slider 40 in the Y-direction, respectively. Each of the arms 418 extends downward from a lower end of the body 416 in parallel to the XZ-plane.

Figure 19:
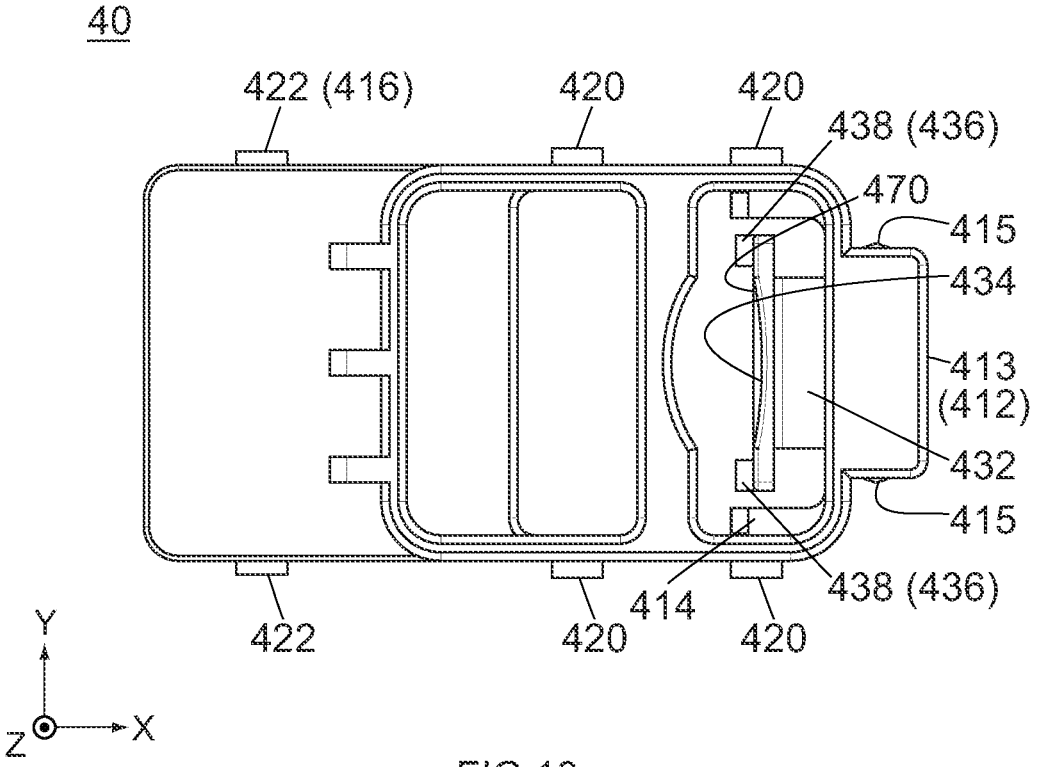
FIG. 19 is a top view showing the slider of the connector of FIG. 17.

As shown in FIGS. 17 and 19, the end wall 412 has a projecting plate 413. The projecting plate 413 is located at an upper end of the end wall 412 and is located at the middle of the end wall 412 in the Y-direction. The projecting plate 413 has a flat-plate shape in parallel to the XY-plane and projects forward. The projecting plate 413 is formed with two stop projections 415. The stop projections 415 project outward in the Y-direction from opposite side surfaces of the projecting plate 413 in the Y-direction, respectively.

As shown in FIGS. 17 and 18, a lower end of the end wall 412 has a U-like shape in the XY-plane. The end wall 412 is provided with an additional portion 414. The additional portion 414 is formed on a lower end of the end wall 412 and protrudes downward from the lower end of the end wall 412. The end wall 412 has opposite parts in the Y-direction which protrude inward in the Y-direction from the lower end of the end wall 412. Each of the arms 418 is provided with a projecting portion 419. Each of the projecting portions 419 projects forward from a lower end of the arm 418.

The slider 40 of the present embodiment has the aforementioned basic structure. However, the present invention is not limited thereto, but the basic structure of the slider 40 can be modified as necessary.

As shown in FIGS. 17 to 19, the slider 40 is provided with four movement-guided portions 420 and two movement-supported portions 422. More specifically, the body 416 has opposite outer side surfaces in the Y-direction. Each of the outer side surfaces is provided with two of the movement-guided portions 420 and one of the movement-supported portions 422. Each of the movement-guided portions 420 and the movement-supported portions 422 is a projection which is formed on the outer side surface of the body 416 in the Y-direction. Each of the movement-guided portions 420 and the movement-supported portions 422 projects outward in the Y-direction. Each of the movement-guided portions 420 has an upper surface which extends in parallel to the XY-plane. Each of the movement-supported portions 422 has an upper surface which is located below the upper surface of each of the movement-guided portions 420 and extends in parallel to the XY-plane.

Referring to FIG. 19, in each of the outer side surfaces of the body 416, two of the movement-guided portions 420 and the movement-supported portion 422 are arranged in the X-direction. The movement-guided portions 420 and the movement-supported portion 422 of one of the outer side surfaces of the body 416 are located at positions same as those of the movement-guided portions 420 and the movement-supported portion 422 of a remaining one of the outer side surfaces of the body 416 in the XZ-plane.

Figure 10:
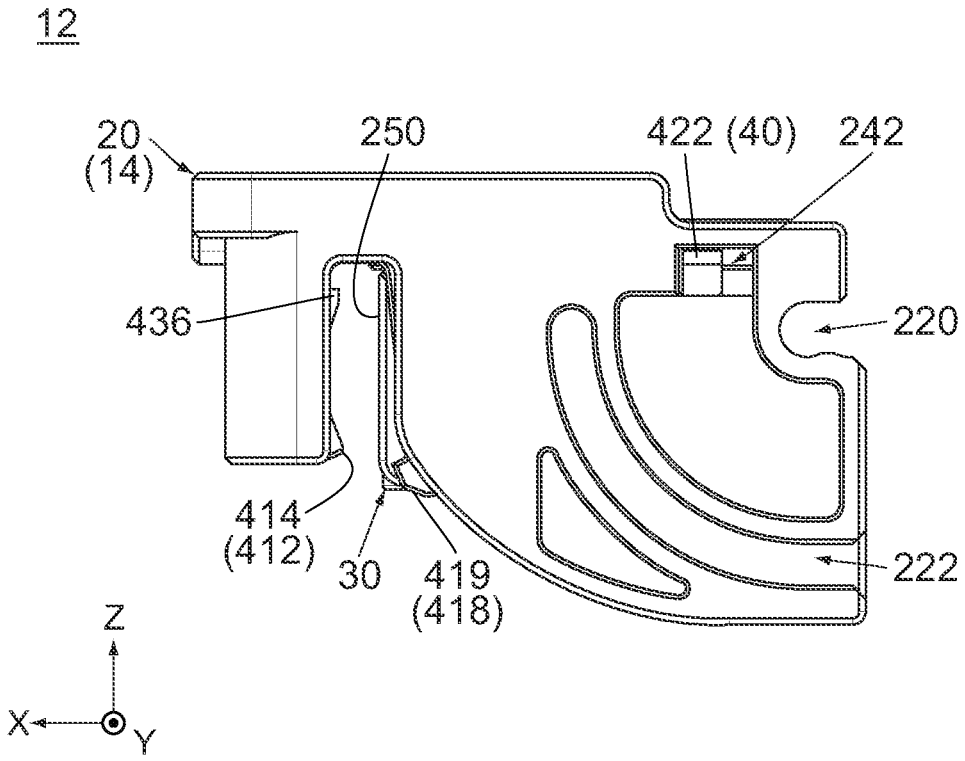
FIG. 10 is a side view showing the connector of FIG. 7.

Referring to FIG. 12, the four movement-guided portions 420 are formed at positions which correspond to the four slider-guide portions 240 of the main housing 20, respectively. Each of the movement-guided portions 420 is received in the corresponding slider-guide portion 240. Referring to FIG. 10, the two movement-supported portions 422 are formed at positions which correspond to the two slider-support portions 242 of the main housing 20, respectively. Each of the movement-supported portions 422 is received in the corresponding slider-support portion 242.

Figure 11:
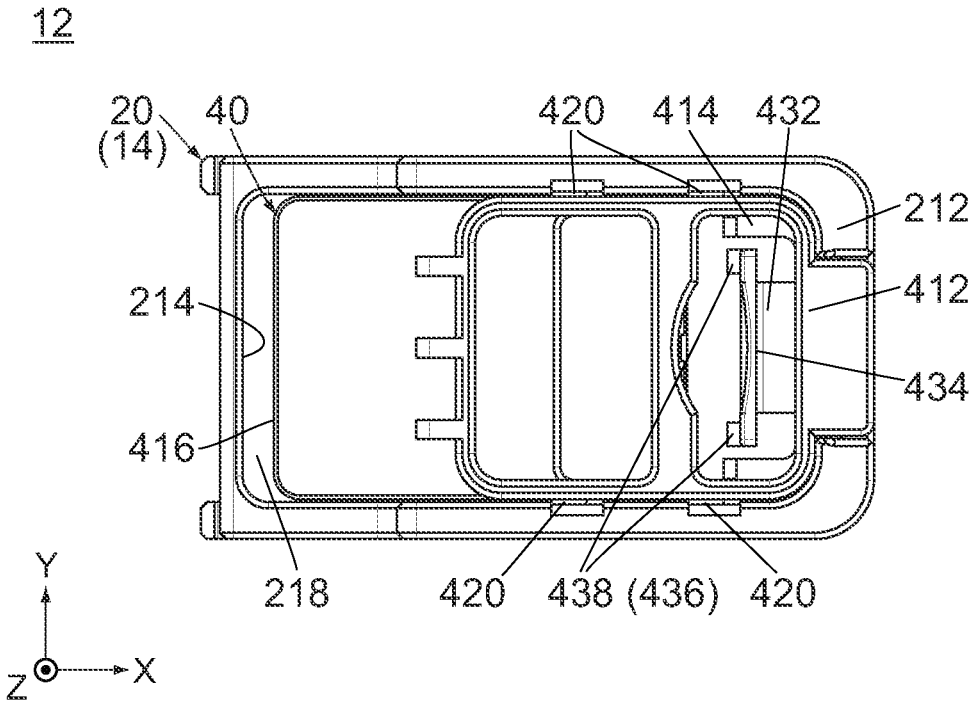
FIG. 11 is a top view showing the connector of FIG. 7.

Referring to FIG. 11, when the movement-guided portions 420 and the movement-supported portions 422 (see FIG. 17) of the slider 40 are received as describe above, the body 416 of the slider 40 is located over the support plate 218 of the main housing 20, and thereby a downward movement of the slider 40 is regulated. Moreover, referring to FIG. 12, the upper surface of each of the movement-guided portions 420 is located under the inner wall surface which is located on the upper side of the corresponding slider-guide portion 240. Referring to FIG. 10, the upper surface of each of the movement-supported portions 422 is located under the inner wall surface which is located on the upper side of the corresponding slider-support portion 242. According to this structure, the slider 40 is supported by the main housing 20 so as not to come off the main housing 20.

Referring to FIGS. 10 and 12, each of the movement-guided portions 420 has a size in the X-direction which is smaller than another size of the corresponding slider-guide portion 240 in the X-direction. Each of the movement-supported portions 422 has a size in the X-direction which is smaller than another size of the corresponding slider-support portion 242 in the X-direction. This structure enables the slider 40 supported by the main housing 20 to be movable relative to the main housing 20 along the X-direction within a predetermined range. Thus, the connector 12 has a support mechanism which supports the slider 40 to be movable relative to the main housing 20. The support mechanism of the present embodiment includes the slider-guide portions 240 and the slider-support portions 242 of the main housing 20 and the movement-guided portions 420 and the movement-supported portions 422 of the slider 40.

Referring to FIG. 11, the slider 40 is held by the housing 14 to be movable between a first position and a second position in a slide direction. The slide direction is the X-direction in FIG. 11, for example. The first position of the present embodiment is a position at which a rear end of the body 416 of the slider 40 is brought into abutment with a front end of the opposite portion 214 of the main housing 20. The second position of the present embodiment is a position at which the end wall 412 of the slider 40 is partially brought into abutment with the base portion 212 of the main housing 20. However, the present invention is not limited thereto. For example, each of the first position and the second position may be defined by another part of the slider 40 and another part of the main housing 20. Moreover, the support mechanism of the slider 40 is not limited to that of the present embodiment.

Referring to FIG. 7, the projecting plate 413 of the slider 40 is received in the indent 213 of the main housing 20. In particular, when the slider 40 is located at the second position, the two stop projections 415 (see FIG. 17) of the projecting plate 413 are pressed against opposite side surfaces of the indent 213 in the Y-direction, respectively. The thus-pressed stop projections 415 temporarily stop the slider 40 at the second position when the slider 40 is moved to the second position. In addition, as can be seen from FIG. 28, the stop projections 415 temporarily stop the slider 40 at the first position when the slider 40 is located at the first position. However, the present invention is not limited thereto. For example, the projecting plate 413 and the stop projections 415 may be provided as necessary.

Figure 20:
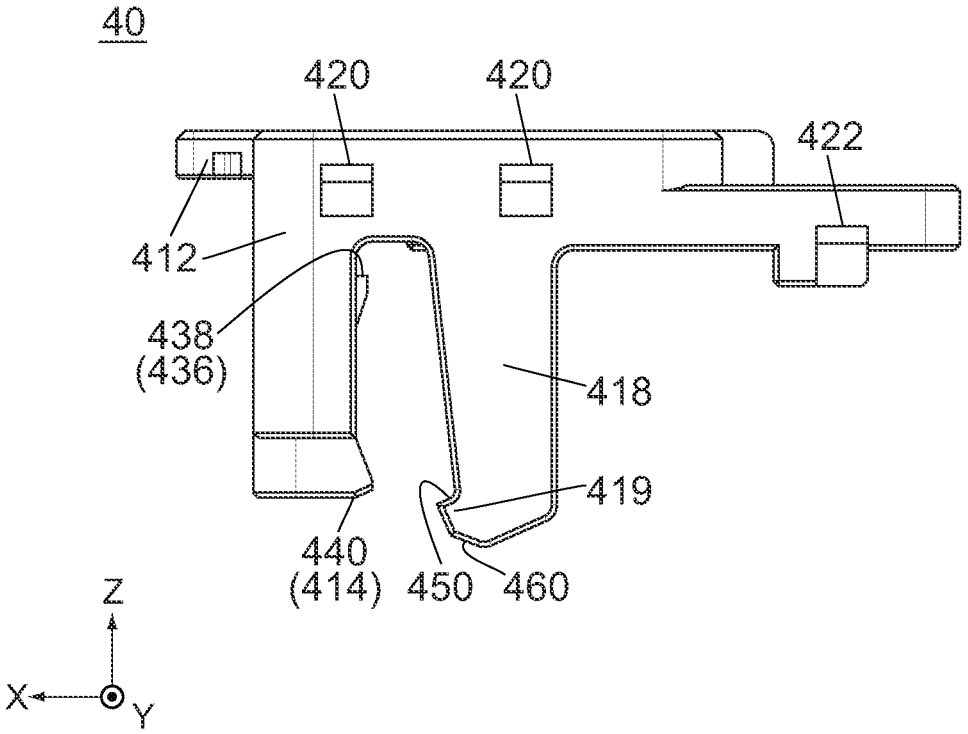
FIG. 20 is a side view showing the slider of the connector of FIG. 17.

Referring to FIGS. 18 and 20, the slider 40 is provided with two first regulated portions 440, two second regulated portions 450 and two abutment portions 460. Each of the first regulated portions 440 of the present embodiment is a part of a lower surface of the additional portion 414. The second regulated portions 450 of the present embodiment are provided so as to correspond to the two arms 418, respectively. Each of the second regulated portions 450 of the present embodiment is a part of an upper surface of the projecting portion 419 of the corresponding arm 418. The abutment portions 460 of the present embodiment are provided so as to correspond to the two arms 418, respectively. Each of the abutment portions 460 of the present embodiment is a part of a lower surface of the corresponding arm 418.

Referring to FIGS. 17 and 18 together with FIG. 19, the slider 40 is provided with a coupling plate 432 and a lock support portion 434. The coupling plate 432 has a flat-plate shape in parallel to the XY-plane and extends rearward from a rear surface of the end wall 412. The lock support portion 434 is located rearward of the end wall 412. The lock support portion 434 extends along the YZ-plane as a whole except for a lower end part thereof. The lock support portion 434 has the lower end part which extends forward. The coupling plate 432 has a rear end which is connected to the middle of the lock support portion 434 in the Z-direction. The thus-supported lock support portion 434 is resiliently deformable.

As shown in FIGS. 18 and 19, the lock support portion 434 is formed with two lock projections 436. Each of the lock projections 436 is a projection which projects rearward. The lock projections 436 are located below a connection portion which is formed between the lock support portion 434 and the coupling plate 432. Each of the lock projections 436 has an upper surface which extends in parallel to the XY-plane and works as a lock portion 438. Thus, the slider 40 is provided with two of the lock portions 438 and the lock support portion 434. The lock support portion 434 supports the lock portions 438. When an upper end of the lock support portion 434 is pushed rearward, the lock portions 438 are moved forward.

Referring to FIG. 19, the slider 40 is provided with a maintained portion 470. The maintained portion 470 of the present embodiment is a rear surface of the lock support portion 434. The maintaining portion 558 faces rearward.

Summarizing the explanation described above with reference to FIGS. 18 and 19, the slider 40 of the present embodiment is provided with the two first regulated portions 440, the two second regulated portions 450, the two abutment portions 460, the two lock portions 438, the lock support portion 434 and the maintained portion 470. Each of these portions has the aforementioned structure and is arranged as described above. However, the present invention is not limited thereto. For example, the number, the structure and the arrangement of each of these portions can be modified as necessary. For example, the number of the first regulated portions 440 may be one or may be three or more. Each of the abutment portions 460, the lock portions 438, the lock support portion 434 and the maintained portion 470 may be provided as necessary.

Referring to FIG. 26, hereafter, explanation will be made about the mating operation and the removing operation of the connector device 10. In the explanation described below, when the position of each portion of the connector device 10 is specified in the XZ-plane, "radial direction" and "circumferential direction" will be used as necessary. In the explanation described below, "radial direction" is a direction along a radius of an imaginary circle about the pivot shafts 520 in the XZ-plane. "Circumferential direction" is another direction along a circumference of the imaginary circle. Each of the radial direction and the circumferential direction is perpendicular to the Y-direction. The radial direction and the circumferential direction are perpendicular to each other. Moreover, each of "clockwise" and "counterclockwise" in the explanation describe below means a turning direction of the connector 12 of the connector device 10 which is seen along the positive Y-direction.

Referring to FIGS. 24 to 27, the connector 12 is attachable to the mating connector 16 along the negative Z-direction from a position above the mating connector 16 under a posture where the connector 12 stands up relative to the mating connector 16. The thus-attached connector 12 is located at the open position shown in FIGS. 24 to 27 and is partially mated with the mating connector 16.

Referring to FIG. 27, when the connector 12 is located at the open position, the power terminal 290 is not connected to the mating power terminals 590, and the detection terminal 390 is not connected to the mating detection terminals 690 (see FIG. 4). Referring to FIG. 26, the slider 40 is held by the housing 14 to be movable between the first position and the second position in the slide direction in parallel to the radial direction about the pivot shafts 520. The slider 40 illustrated in FIG. 27 is located at the first position.

Figure 30:
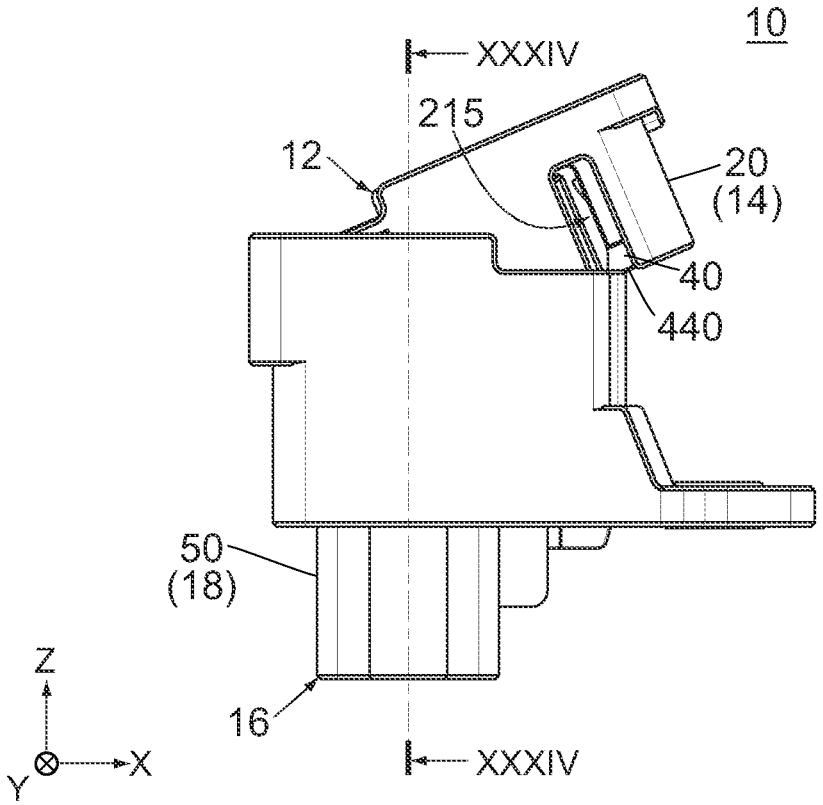
FIG. 30 is a side view showing the connector device of FIG. 28.
Figure 31:
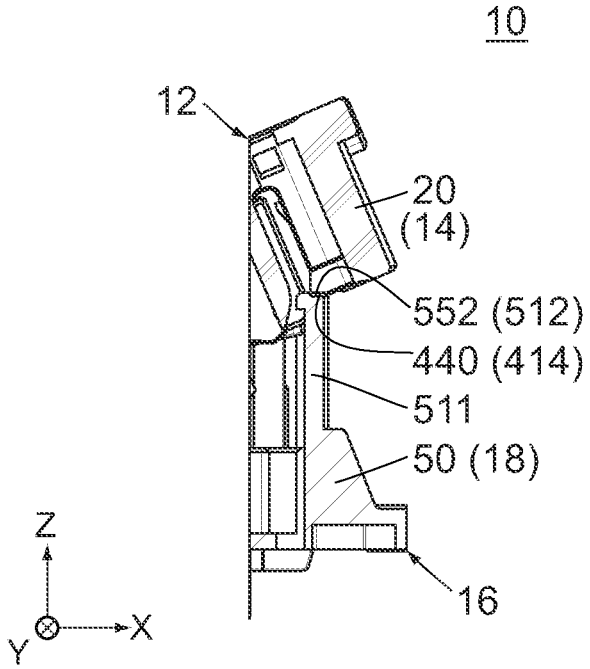
FIG. 31 is a partial, cross-sectional view showing the connector device of FIG. 29, taken along line XXXI-XXXI.

Referring to FIGS. 28 to 34 together with FIG. 24, when the connector 12 is clockwise turned along the circumferential direction about the mating axis portions 520 (see FIG. 26), the connector 12 is moved from the open position shown in FIG. 24 to the predetermined position shown in FIGS. 28 to 34. Referring to FIG. 31 together with FIG. 4, when the connector 12 is moved to the predetermined position, the first regulated portions 440 of the slider 40 are brought into abutment with the first regulation portions 552 of the mating housing 18, respectively. As a result, a further turn of the connector 12 is temporarily regulated, and the connector 12 is temporarily kept at the predetermined position.

As described above, when the connector 12 is moved to the predetermined position together with the slider 40 which is located at the first position in accordance with a movement of the connector 12 from the open position toward the closed position, the first regulated portions 440 are brought into abutment with the first regulation portions 552, and the connector 12 takes a first regulated state where a movement of the connector 12 toward the closed position beyond the predetermined position is regulated.

Figure 33:
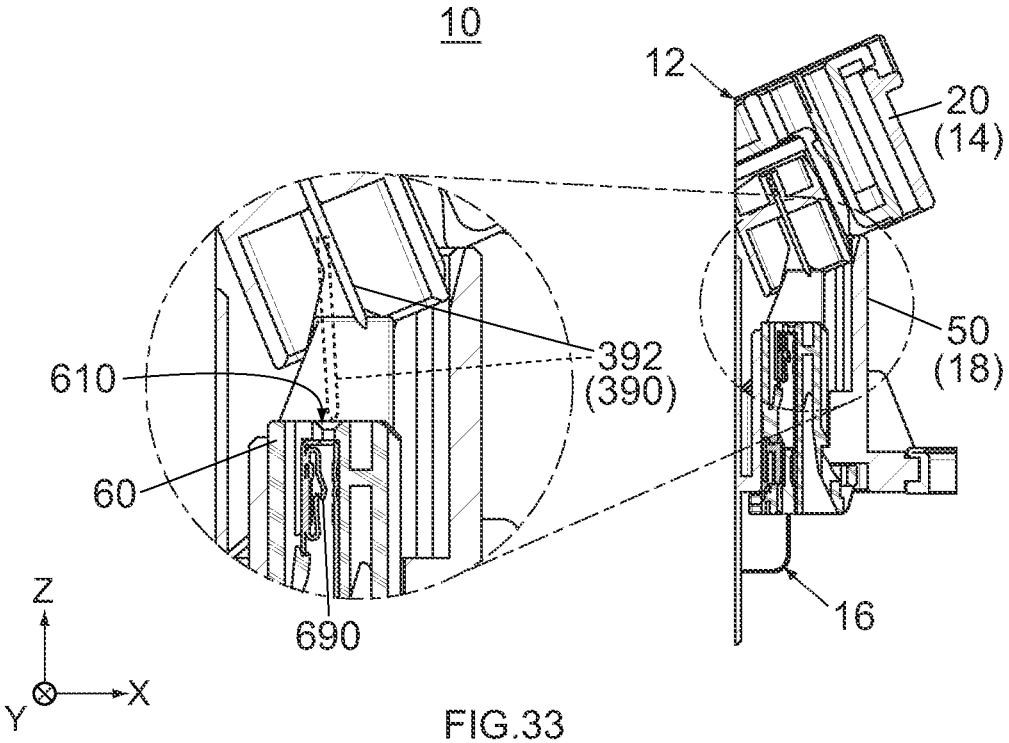
FIG. 33 is a partial, cross-sectional view showing the connector device of FIG. 29, taken along line XXXIII-XXXIII, wherein a part of the connector device enclosed by chain dotted lines is enlarged and illustrated, and in the enlarged view, an outline of the detection terminal of the connector which is moved toward the closed position is partially illustrated with dashed line.
Figure 34:
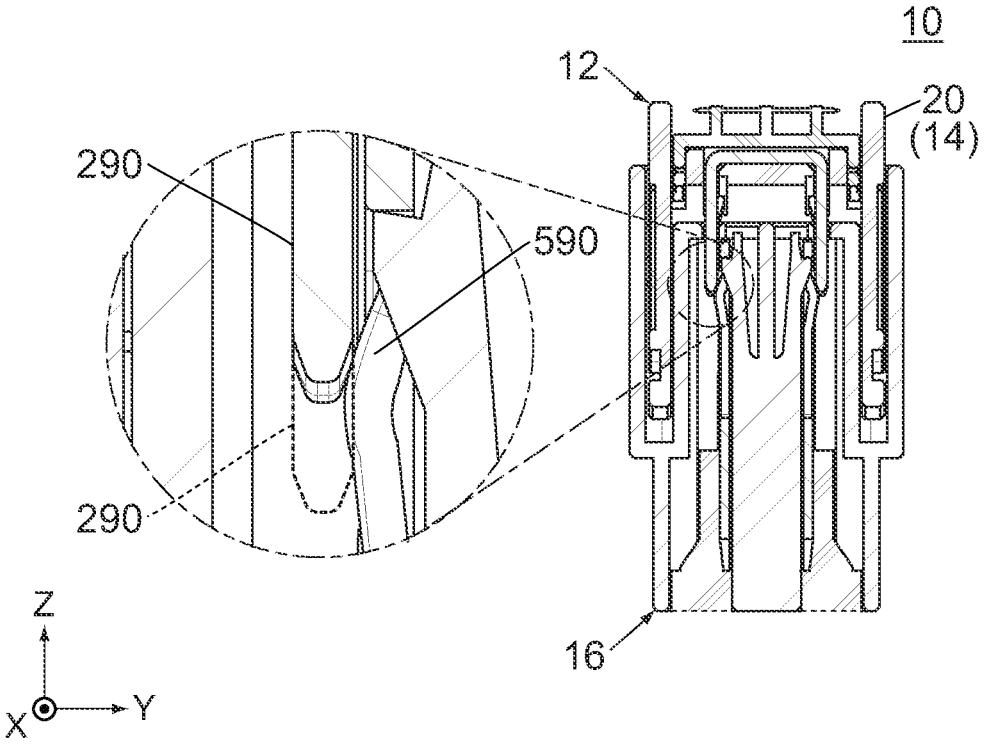
FIG. 34 is a cross-sectional view showing the connector device of FIG. 30, taken along line XXXIV-XXXIV, wherein a lower part of the power cable is not illustrated, a part of the connector device enclosed by chain dotted lines is enlarged and illustrated, and in the enlarged view, an outline of a power terminal of the connector which is moved toward the closed position is partially illustrated with dashed line.

Referring to FIG. 34, when the connector 12 is located at the predetermined position, the power terminal 290 is connected to the two mating power terminals 590, and thereby the mating power terminals 590 are connected with each other. However, referring to FIG. 33, the detection terminal 390 is not connected to the mating detection terminals 690, and thereby the two signal cables 840 (see FIG. 2) are not connected with each other. Therefore, the control by the power system (not shown) makes electric current not flow through the power cables 820 (see FIG. 2).

Figure 35:
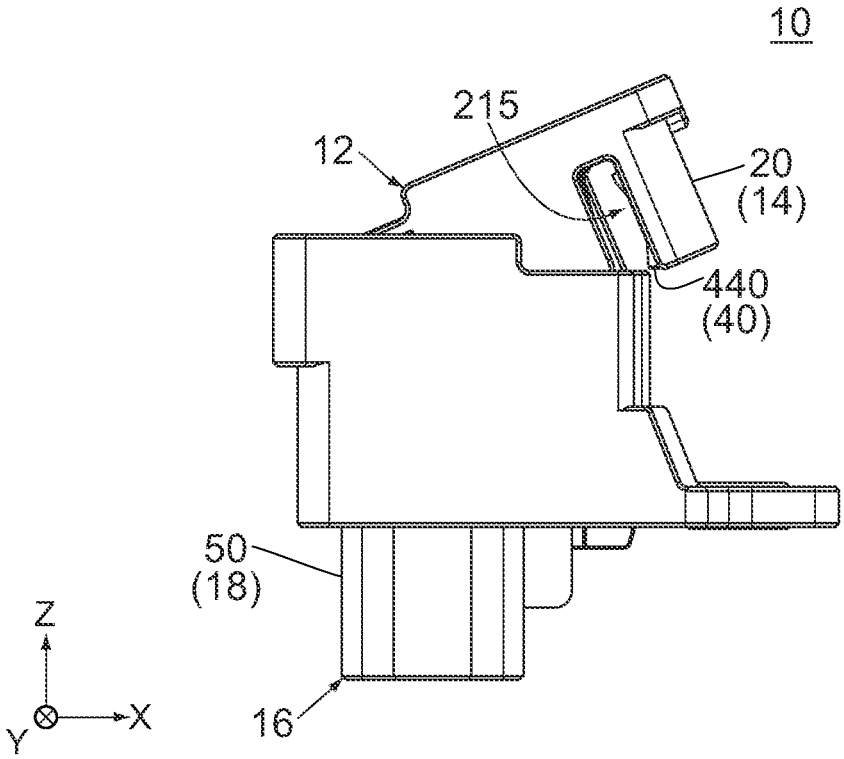
FIG. 35 is a side view showing the connector device of FIG. 30, wherein the connector is located at the predetermined position, and the slider is located at the second position.
Figure 36:
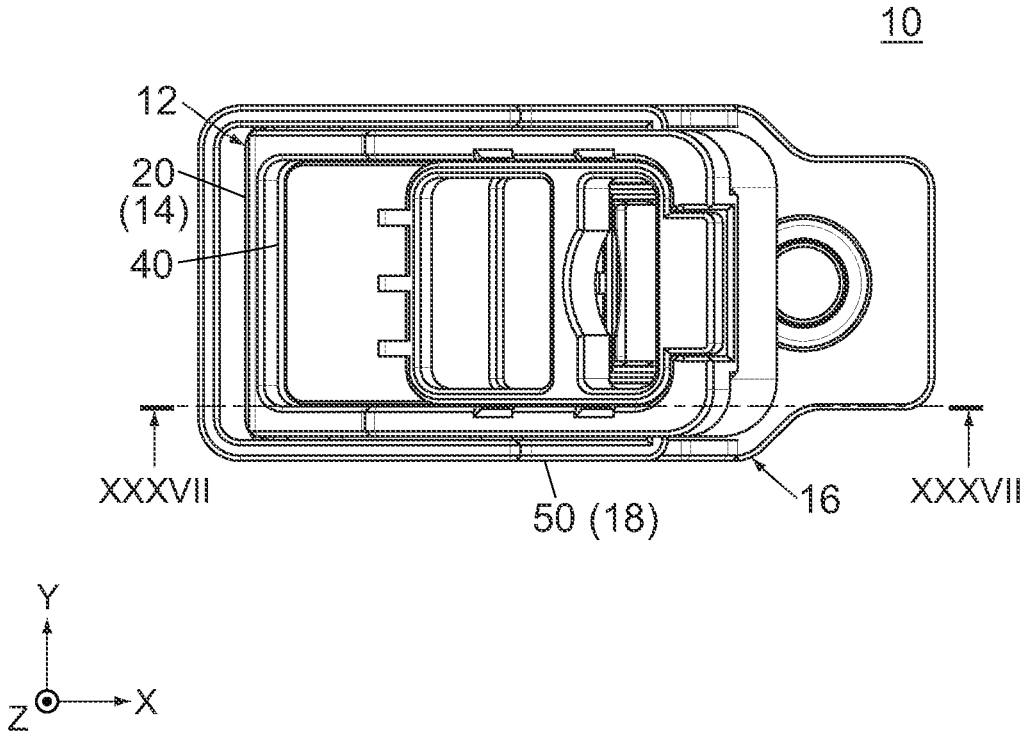
FIG. 36 is a top view showing the connector device of FIG. 35.
Figure 37:
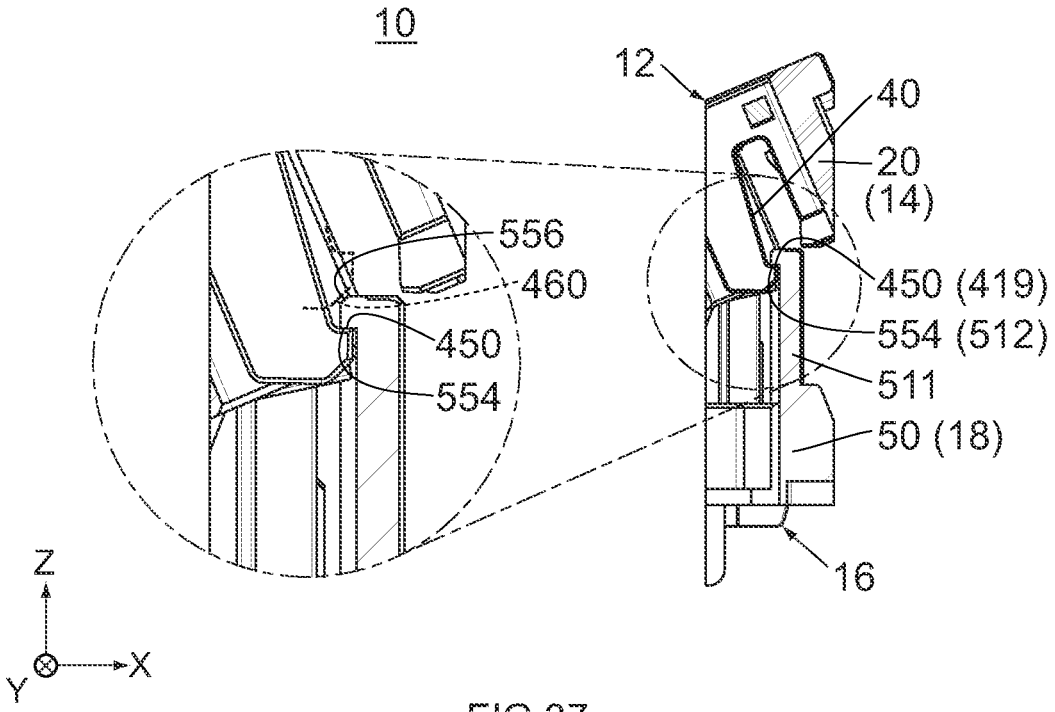
FIG. 37 is a partial, cross-sectional view showing the connector device of FIG. 36, taken along line XXXVII-XXXVII, wherein a part of the connector device enclosed by chain dotted lines is enlarged and illustrated, and in the enlarged view, an outline of the slider of the connector which is located at another position is partially illustrated with dashed line.

Referring to FIGS. 35 to 37 together with FIG. 31, when the connector 12 is located at the predetermined position, the slider 40 is operable so as to be moved to the second position. When the slider 40 is moved to the second position, the first regulated portions 440 of the slider 40 are moved outward in the slide direction which is in parallel to the radial direction to be apart from the first regulation portions 552 of the mating housing 18. As a result, the first regulated state is released, and the connector 12 is turnable toward the closed position shown in FIG. 38. As described above, when the slider 40 of the connector 12 which is under the first regulated state is moved to the second position, the first regulated state is released, and the connector 12 is movable to the closed position.

Referring to FIGS. 38 to 43 together with FIG. 35, when the thus-released connector 12 is clockwise turned along the circumferential direction, the connector 12 is moved from the predetermined position shown in FIG. 35 to the closed position shown in FIGS. 38 to 43.

Referring to FIG. 34, during a movement of the connector 12 from the predetermined position to the closed position, the connection of the power terminal 290 to the two mating power terminals 590 is kept (see the power terminal 290 illustrated with dashed line). Thus, when the connector 12 is located at the closed position, the power terminal 290 is connected to the two mating power terminals 590.

Figure 43:
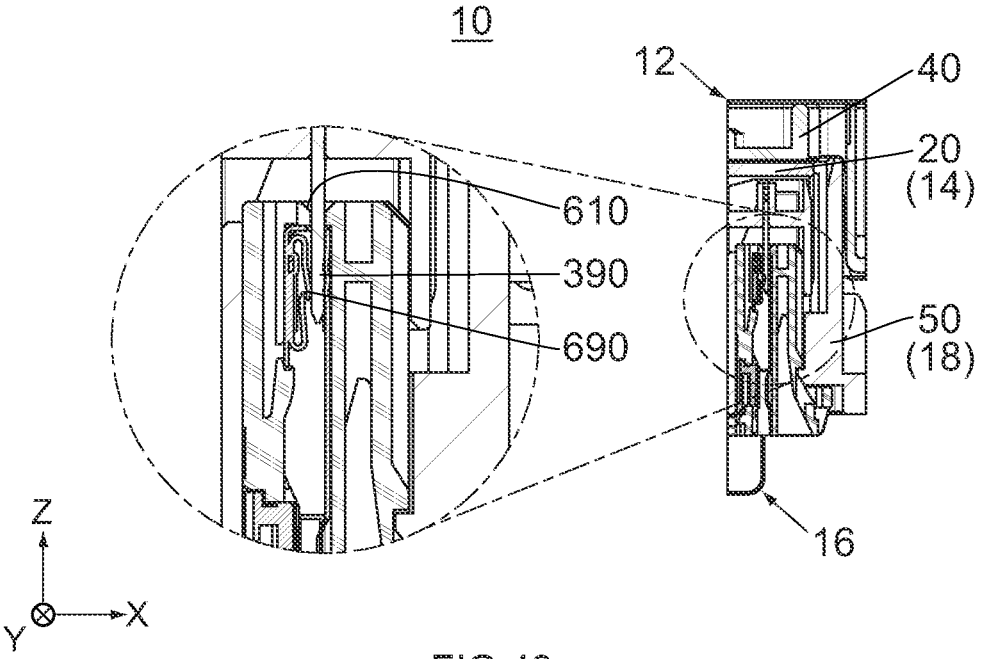
FIG. 43 is a partial, cross-sectional view showing the connector device of FIG. 39, taken along line XLII-XLII, wherein a part of the connector device enclosed by chain dotted lines is enlarged and illustrated.
Figure 44:
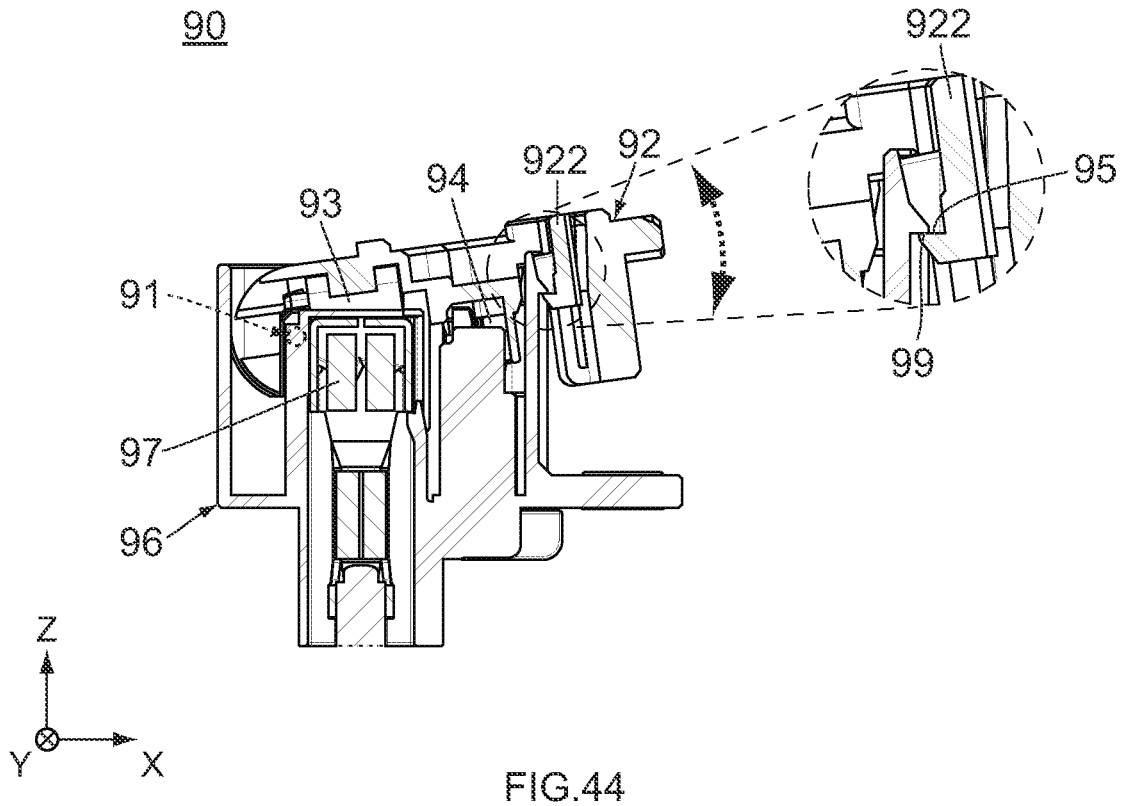
FIG.44 PRIOR ART
FIG. 44 is a cross-sectional view showing a connector device of Patent Document 1.

Referring to FIG. 43, when the connector 12 is located at the closed position, the detection terminal 390 is connected to the two mating detection terminals 690, and thereby the mating detection terminals 690 are connected with each other. At that time, the connector 12 is under the mated state where it completely mated with the mating connector 16, and the control by the power system (not shown) makes a large current about 100 A flow through the power cables 820 (see FIG. 2). As described above, when the connector 12 is completely mated with the mating connector 16, the connector device 10 connects the power system and the motor (not shown) with each other so that electric power supplied from the power system is transmitted to the motor.

Figure 41:
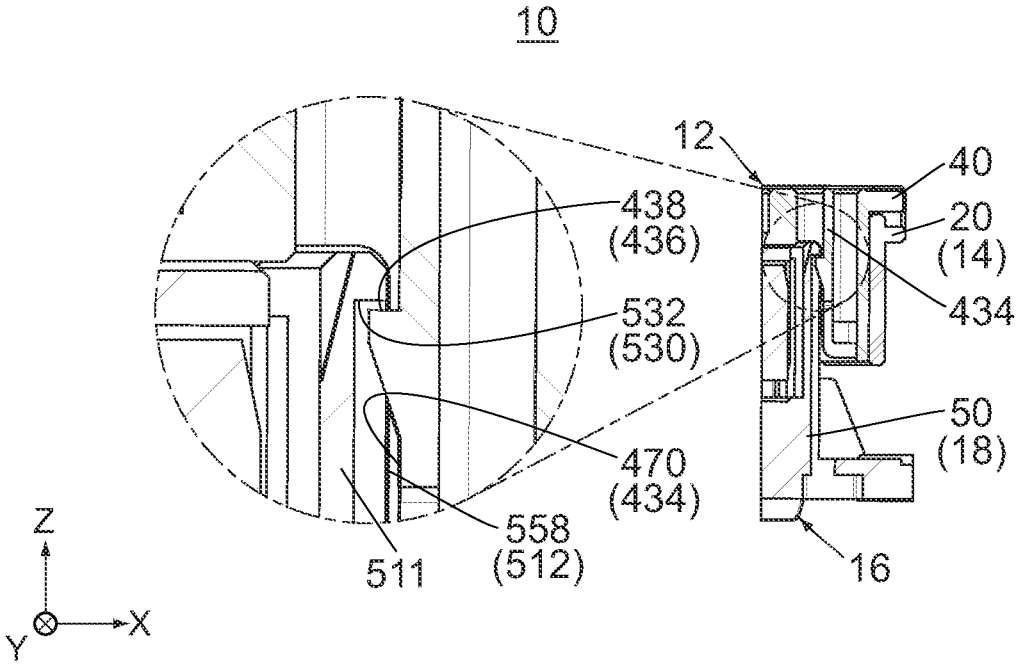
FIG. 41 is a partial, cross-sectional view showing the connector device of FIG. 39, taken along line XLI-XLI, wherein a part of the connector device enclosed by chain dotted lines is enlarged and illustrated.
Figure 42:
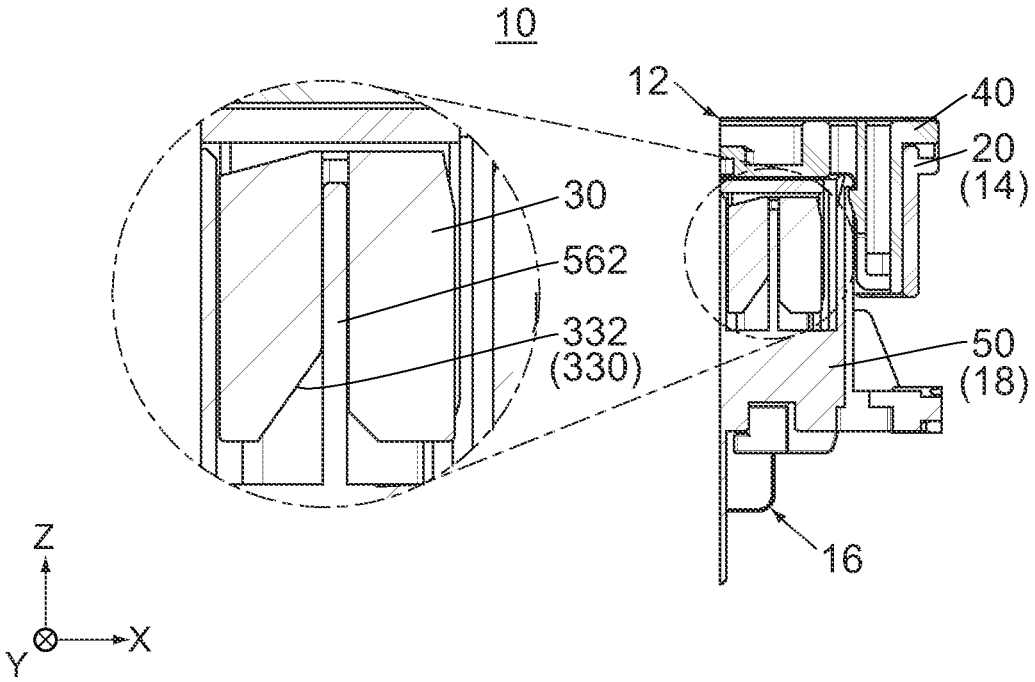
FIG. 42 is a partial, cross-sectional view showing the connector device of FIG. 39, taken along line XLII-XLII, wherein a part of the connector device enclosed by chain dotted lines is enlarged and illustrated.

Referring to FIG. 41, the lock portions 438 of the slider 40 is brought into abutment with an upper end of the protruding portion 512 of the mating connector 16 in a movement of the connector 12 toward the closed position. Meanwhile, the lock support portion 434 of the slider 40 is resiliently deformed, and the lock portions 438 ride over the mating lock portions 532 of the mating connector 16 to be moved downward. When the connector 12 is moved to the closed position, the lock portions 438 are located under the mating lock portions 532, respectively. As a result, a counterclockwise movement of the connector 12 is prevented, and thereby the connector 12 is kept under the mated state. Thus, the lock portions 438 and the mating lock portions 532 of the present embodiment lock the mated state.

As described above, the lock portions 438 and the mating lock portions 532 of the present embodiment form a lock mechanism which locks the mated state. The lock portions 438 of the present embodiment are supported so as to be movable relative to the slider 40. The mating lock portions 532 of the present embodiment is fixed so as to be unmovable relative to the mating main housing 50. However, the present invention is not limited thereto. For example, the lock portions 438 may be fixed so as to be unmovable relative to the slider 40. The mating lock portions 532 may be supported so as to be movable relative to the mating connector 16. Moreover, the lock mechanism may be provided as necessary.

When the connector 12 is located at the closed position, the maintained portion 470 of the slider 40 is located outward of the maintaining portion 558 of the mating connector 16 in the slide direction which is in parallel to the radial direction, or the X-direction in FIG. 41. The maintained portion 470 is in contact with the maintaining portion 558 or faces the maintaining portion 558 with a slight distance therebetween in the slide direction. Therefore, the slider 40 cannot be moved to the first position. In detail, upon an attempt where the slider 40 of the connector 12 which is located at the closed position is moved from the second position toward the first position, the maintained portion 470 is brought into abutment with the maintaining portion 558, and the slider 40 is maintained at the second position.

Under a state where the connector 12 is located at the closed position, when an upper end portion of the lock support portion 434 of the slider 40 is operated to be moved inward in the slide direction, or in the negative X-direction in FIG. 41, the lock support portion 434 is resiliently deformed, and thereby the lock portions 438 are moved outward in the slide direction. As a result, the lock of the mated state by the lock portions 438 and the mating lock portions 532 is released, and thereby the connector 12 is counterclockwise turnable.

Referring to FIGS. 35 to 38, when the connector 12 is counterclockwise turned along the circumferential direction, the connector 12 is moved from the closed position shown in FIG. 38 to the predetermined position shown in FIGS. 35 to 37. Referring to FIG. 37, when the connector 12 is moved to the predetermined position, the two second regulated portions 450 of the slider 40 are brought into abutment with the second regulation portions 554 of the mating housing 18, respectively. As a result, a further turn of the connector 12 is temporarily regulated, and the connector 12 is temporarily kept at the predetermined position.

As described above, when the connector 12 is moved to the predetermined position together with the slider 40 which is located at the second position in accordance with a movement of the connector 12 from the closed position toward the open position, the second regulated portions 450 are brought into abutment with the second regulation portions 554, and the connector 12 takes a second regulated state where a movement of the connector 12 toward the open position beyond the predetermined position is regulated.

Referring to FIG. 34, when the connector 12 is moved to the predetermined position, the connection of the power terminal 290 to the mating power terminals 590 is kept. Referring to FIG. 33, when the connector 12 is moved to the predetermined position, the detection terminal 390 is disconnected from the mating detection terminals 690. As a result, the control by the power system (not shown) stops the electric current supplied to the power cables 820 (see FIG. 2).

Referring to FIGS. 28 to 31 together with FIG. 37, when the connector 12 is located at the predetermined position, the slider 40 is operable so as to be moved to the first position. When the slider 40 is moved to the first position, the two second regulated portions 450 of the slider 40 are moved inward in the slide direction which is in parallel to the radial direction to be apart from the second regulation portions 554 of the mating housing 18. As a result, the second regulated state is released, and the connector 12 is turnable toward the open position shown in FIG. 24. As described above, when the slider 40 of the connector 12 which is located at the second regulated state is moved to the first position, the second regulated state is released, and the connector 12 is movable to the open position.

Referring to FIG. 27, when the connector 12 is moved to the open position, the power terminal 290 is disconnected from the mating power terminals 590. The connector 12 which is moved to the open position can be removed from the mating connector 16.

Referring to FIG. 37, according to the present embodiment, when the connector 12 is located at the predetermined position, the second regulated state is not released unless the slider 40 is moved to the first position. Referring to FIG. 27, the power terminal 290 can be disconnected from the mating power terminals 590 by moving the connector 12 to the open position after the release of the second regulated state. As can be seen from the explanation described above, the present embodiment provides a sufficiently long period between the disconnection of the detection terminal 390 (see FIG. 33) and the disconnection of the power terminal 290. Thus, according to the present invention, an operator can touch the power terminal 290 and the mating power terminals 590 only when the sufficiently long period has passed after the stop of the electric current. Therefore, electric shock of the operator can be prevented.

In addition, the present embodiment also provides a sufficiently long period between the connection of the power terminal 290 and the connection of the detection terminal 390 (see FIG. 33). According to the present embodiment, damage of the power terminal 290 which might be caused because of arc discharge can be prevented, for example.

According to the present embodiment, the slider 40 which is used to release the movement regulation can be arranged above the housing 14, for example. Thus, the slider 40 does not need to be provided on an outer end of the housing 14 in the radial direction. Therefore, the connector 12 can be reduced in size. The present embodiment provides the connector device 10 which is configured to provide the sufficiently long period between disconnection of the detection terminal 390 (see FIG. 33) and disconnection of the power terminal 290 and which enables the connector 12 to be reduced in size.

Referring to FIG. 41, as previously described, the maintained portion 470 and the maintaining portion 558 of the present embodiment prevent a movement of the slider 40 to the first position when the connector 12 is located at the closed position. If the slider 40 of the connector 12 which is located at the closed position is movable to the first position, an irregular operation might move the connector 12 to the open position without placing the connector 12 under the aforementioned second regulated state. In contrast, the connector 12 of the present embodiment reliably takes the second regulated state in a movement of the connector 12 from the closed position to the open position. However, the present invention is not limited thereto. For example, the maintained portion 470 and the maintaining portion 558 may be provided as necessary.

Referring to FIG. 37, if the connector 12 is moved to the predetermined position together with the slider 40 which is located at the second position in accordance with a movement of the connector 12 from the open position toward the closed position, the abutment portions 460 (see dashed line in FIG. 37) of the slider 40 are brought into abutment with the catch portions 556 of the mating housing 18, respectively. At that time, the abutment portions 460 extend rearward and downward similarly to the catch portions 556. The abutment portions 460 which are brought into abutment with the sloping surfaces of the catch portions 556 receive a rearward force. Referring to FIG. 31, as a result, the slider 40 is moved to the first position, and thereafter the first regulated portions 440 of the slider 40 are brought into abutment with the first regulation portions 552 of the mating housing 18, respectively.

As described above, referring to FIGS. 31 and 37, when the connector 12 is moved from the open position toward the closed position together with the slider 40 which is located at the second position, the abutment portions 460 are brought into abutment with the catch portions 556, and the slider 40 is moved to the first position. According to the present embodiment, because the abutment portions 460 and the catch portions 556 are provided, the connector 12 reliably takes the aforementioned first regulated state in accordance with a movement of the connector 12 from the open position to the closed position. However, the present invention is not limited thereto. For example, the abutment portions 460 and the catch portions 556 may be provided as necessary.

Referring to FIGS. 30 and 35, according to the present embodiment, the position of the first regulated portions 440 of the slider 40 can be visually recognized through the windows 215 of the main housing 20. Therefore, the operator can easily perform a proper operation while visually recognizing the position of the first regulated portions 440. However, the present invention is not limited thereto. For example, the windows 215 may be provided as necessary.

Figure 32:
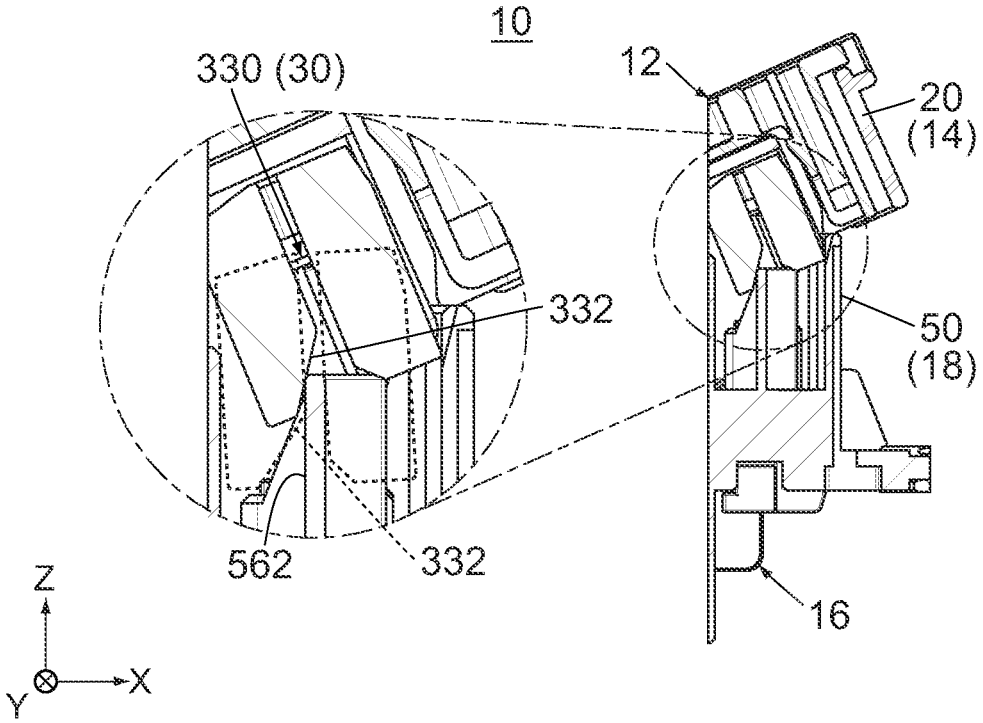
FIG. 32 is a partial, cross-sectional view showing the connector device of FIG. 29, taken along line XXXII-XXXIII, wherein a part of the connector device enclosed by chain dotted lines is enlarged and illustrated, and in the enlarged view, an outline of the sub-housing of the connector which is moved toward a closed position is partially illustrated with dashed line.

Referring to FIG. 27, when the connector 12 is located at the open position, the sub-housing 30 is located at the first limit position in which the first abutment surface 312 of the sub-housing 30 is in abutment with the support plate 218 of the main housing 20. Referring to FIG. 32, when the connector 12 is moved from the open position to the predetermined position, the connection-guide portions 562 of the mating connector 16 are brought into abutment with the guided surfaces 332 of the sub-housing 30, respectively, and thereafter are moved along the guided surfaces 332. In other words, the guided surfaces 332 are moved downward while being in contact with the connection-guide portions 562. As a result, the sub-housing 30 is turned toward the second limit position (see the sub-housing 30 illustrated with dashed line in FIG. 32). While the connector 12 is moved from the predetermined position to the closed position, the turning movement of the sub-housing 30 toward the second limit position continues.

Referring to FIG. 33, as a result of the aforementioned turning movement of the sub-housing 30, when the connector 12 is close to the closed position, lower ends of the pin terminals 392 of the detection terminal 390 are located just over the connection holes 610 of the mating sub-housing 60, respectively. Referring to FIG. 43, when the connector 12 is moved to the closed position, the pin terminals 392 are brought into contact with the mating detection terminals 690, respectively, through the connection holes 610, respectively. Referring to FIGS. 32 and 33, as described above, upon a movement of the connector 12 from the open position to the closed position, the connection-guide portions 562 of the present embodiment guide the connection guided portions 330 to adjust a posture of the sub-housing 30 so that the detection terminal 390 is connected to the mating detection terminals 690. However, the present invention is not limited thereto. For example, the connection-guide portions 562 and the connection guided portions 330 may be provided as necessary.

What is claimed is:

1. A connector device comprising a connector and a mating connector, wherein:

the connector and the mating connector are mateable with each other;

the connector comprises a housing, a power terminal and a detection terminal;

the power terminal and the detection terminal are held by the housing;

the mating connector comprises a mating housing, a mating power terminal and a mating detection terminal;

the mating power terminal and the mating detection terminal are held by the mating housing;

the housing is provided with an axis portion;

the mating housing is provided with a mating axis portion;

one of the axis portion and the mating axis portion is a pivot shaft, and a remaining one of the axis portion and the mating axis portion is a bearing;

when the axis portion is combined to the mating axis portion, the connector is turnable about the pivot shaft between an open position and a closed position via a predetermined position;

when the connector is located between the open position and the closed position, the connector is located is located at an upper side of the mating connector in an upper-lower direction perpendicular to an axis direction of the pivot shaft;

when the connector is located at the open position, the power terminal is not connected to the mating power terminal, and the detection terminal is not connected to the mating detection terminal;

when the connector is located at the predetermined position, the power terminal is connected to the mating power terminal, but the detection terminal is not connected to the mating detection terminal;

when the connector is located at the closed position, the power terminal is connected to the mating power terminal, and the detection terminal is connected to the mating detection terminal;

the connector further comprises a slider;

the slider is held by the housing to be movable between a first position and a second position in a slide direction in parallel to a radial direction about the pivot shaft;

the slider is provided with a first regulated portion and a second regulated portion;

the mating housing is provided with a first regulation portion and a second regulating portion;

when the connector is moved to the predetermined position together with the slider which is located at the first position in accordance with a movement of the connector from the open position toward the closed position, the first regulated portion is brought into abutment with the first regulation portion, and the connector takes a first regulated state where a movement of the connector toward the closed position beyond the predetermined position is regulated;

when the slider of the connector which is under the first regulated state is moved to the second position, the first regulated state is released, and the connector is movable to the closed position;

when the connector is moved to the predetermined position together with the slider which is located at the second position in accordance with a movement of the connector from the closed position toward the open position, the second regulated portion is brought into abutment with the second regulation portion, and the connector takes a second regulated state where a movement of the connector toward the open position beyond the predetermined position is regulated; and when the slider of the connector which is under the second regulated state is moved to the first position, the second regulated state is released, and the connector is movable to the open position.

2. The connector device as recited in claim 1, wherein:

the housing comprises a main housing and a sub-housing;

the sub-housing is held by the main housing to be swingable;

the axis portion is provided to the main housing;

the power terminal is held by the main housing; and the detection terminal is held by the sub-housing.

3. The connector device as recited in claim 2, wherein:

the sub-housing is provided with a connection guided portion;

the mating housing is provided with a connection guide portion; and upon a movement of the connector from the open position to the closed position, the connection guide portion guides the connection guided portion to adjust a posture of the sub-housing so that the detection terminal is connected to the mating detection terminal.

4. The connector device as recited in claim 1, wherein:

the housing is provided with a guide portion;

the mating housing is provided with a mating guide portion; and the guide portion and the mating guide portion guide a movement of the connector between the open position and the closed position.

5. The connector device as recited in claim 1, wherein:

the slider is provided with a lock portion and a lock support portion;

the lock support portion is resiliently deformable and supports the lock portion;

the mating housing is provided with a mating lock portion; and the lock portion and the mating lock portion lock a mated state where the connector and the mating connector are mated with each other.

6. The connector device as recited in claim 1, wherein:

the slider is provided with an abutment portion;

the mating housing is provided with a catch portion; and when the connector is moved from the open position toward the closed position together with the slider which is located at the second position, the abutment portion is brought into abutment with the catch portion, and the slider is moved to the first position.

7. The connector device as recited in claim 1, wherein:

the slider is provided with a maintained portion;

the mating housing is provided with a maintaining portion; and upon an attempt where the slider of the connector which is located at the closed position is moved from the second position toward the first position, the maintained portion is brought into abutment with the maintaining portion, and the slider is maintained at the second position.

* * * * *